US010648436B2

(12) United States Patent
Adachi et al.

(10) Patent No.: US 10,648,436 B2
(45) Date of Patent: May 12, 2020

(54) FUEL SUPPLY DEVICE

(71) Applicant: DENSO CORPORATION, Kariya, Aichi-pref. (JP)

(72) Inventors: Rui Adachi, Kariya (JP); Tadashi Hazama, Kariya (JP); Norihiro Hayashi, Kariya (JP); Takashi Akiba, Kariya (JP); Shingo Fukuoka, Kariya (JP)

(73) Assignee: DENSO CORPORATION, Kariya (JP)

( * ) Notice: Subject to any disclaimer, the term of this patent is extended or adjusted under 35 U.S.C. 154(b) by 12 days.

(21) Appl. No.: 16/076,819

(22) PCT Filed: Feb. 24, 2017

(86) PCT No.: PCT/JP2017/006967

§ 371 (c)(1),
(2) Date: Aug. 9, 2018

(87) PCT Pub. No.: WO2017/159276

PCT Pub. Date: Sep. 21, 2017

(65) Prior Publication Data

US 2019/0017474 A1 Jan. 17, 2019

(30) Foreign Application Priority Data

Mar. 14, 2016 (JP) ..... 2016-049806
Sep. 16, 2016 (JP) ..... 2016-182067

(51) Int. Cl.

| | |
|---|---|
| ***F02M 55/02*** | (2006.01) |
| ***F02M 37/10*** | (2006.01) |
| ***F02M 37/00*** | (2006.01) |
| ***F02M 63/02*** | (2006.01) |
| *F02D 33/00* | (2006.01) |
| *F02D 41/30* | (2006.01) |

(52) U.S. Cl.

CPC ..... *F02M 37/106* (2013.01); *F02M 37/0052* (2013.01); *F02M 37/0082* (2013.01);
(Continued)

(58) Field of Classification Search

CPC .... B01D 2201/16; B01D 29/11; B01D 35/26; B60K 15/03; B60K 2015/03217;
(Continued)

(56) References Cited

U.S. PATENT DOCUMENTS 4,084,359 A * 4/1978 Snell ..... E04H 12/182 52/119
2007/0215115 A1* 9/2007 Hazama ..... F02D 33/003 123/458

(Continued)

FOREIGN PATENT DOCUMENTS

JP 10-252592 9/1998
JP 2012-184760 9/2012

(Continued)

*Primary Examiner* — John Kwon
(74) *Attorney, Agent, or Firm* — Nixon & Vanderhye P.C.

(57) ABSTRACT

A fuel supply device configured to supply fuel from an inside of a fuel tank to an internal combustion engine includes: a cover body that is installed to an upper wall of the fuel tank; a pump unit that is placed on a bottom wall of the fuel tank and is configured to discharge the fuel from the inside of the fuel tank toward the internal combustion engine; and a coupling stay that couples between the cover body and the pump unit. The coupling stay includes: an upper stay that extends on a lower side of the cover body; and a lower stay that is installed to the pump unit and is slidably fitted to the upper stay in a top-to-bottom direction. A stress concentrating portion, which reduces a section modulus to concentrate a stress around the stress concentrating portion, is formed at a specific location of the lower stay.

16 Claims, 34 Drawing Sheets

(52) U.S. Cl.
CPC ..... *F02M 63/0275* (2013.01); *F02D 33/006* (2013.01); *F02D 41/3082* (2013.01)

(58) Field of Classification Search
CPC ..... F02M 37/00; F02M 37/007; F02M 37/22; F02M 37/50; F02M 37/0052; F02M 37/10; G01F 23/38
USPC ..... 123/445, 468, 469, 470, 195 R, 195 A, 123/195 H
See application file for complete search history.

(56) References Cited

U.S. PATENT DOCUMENTS

| | | | | |
|---|---|---|---|---|
| 2011/0073064 | A1* | 3/2011 | Mavinahally | F01L 1/02 123/195 R |
| 2012/0060948 | A1* | 3/2012 | Okazono | F02M 37/0017 137/565.17 |
| 2017/0268471 | A1 | 9/2017 | Fukui et al. | |
| 2018/0274504 | A1* | 9/2018 | Hayashi | F02M 37/103 |
| 2018/0328323 | A1* | 11/2018 | Fukuoka | F02M 37/0052 |
| 2019/0009670 | A1* | 1/2019 | Adachi | F02M 37/00 |
| 2019/0010905 | A1* | 1/2019 | Hayashi | F02M 37/50 |
| 2019/0024615 | A1* | 1/2019 | Hayashi | F02M 37/00 |
| 2019/0078541 | A1* | 3/2019 | Kobayashi | B60K 15/03 |
| 2019/0136809 | A1* | 5/2019 | Fujiseki | F02M 37/103 |
| 2019/0170097 | A1* | 6/2019 | Hayashi | F02M 37/10 |
| 2019/0211785 | A1* | 7/2019 | Akiba | F02M 37/00 |

FOREIGN PATENT DOCUMENTS

| | | |
|---|---|---|
| JP | 5462409 | 4/2014 |
| JP | 2014-109255 | 6/2014 |
| WO | 2012/022570 | 2/2012 |

* cited by examiner

FUEL SUPPLY DEVICE

CROSS REFERENCE TO RELATED APPLICATION

This application is the U.S. national phase of International Application No. PCT/JP2017/006967 filed Feb. 24, 2017, and is based on and incorporates herein by reference the entire contents of Japanese Patent Application No. 2016-49806 filed on Mar. 14, 2016 and Japanese Patent Application No. 2016-182067 filed on Sep. 16, 2016.

TECHNICAL FIELD

The present disclosure relates to a fuel supply device that is configured to supply fuel from an inside of a fuel tank to an internal combustion engine.

BACKGROUND ART

Previously, an in-tank fuel supply device, which is placed in the inside of the fuel tank, is widely used at the internal combustion engine of a vehicle. In a device, which is disclosed in the patent literature 1 as this kind of fuel supply device, a coupling stay couples between a cover body, which is installed to an upper wall of the fuel tank, and a pump unit, which is placed on a bottom wall of the fuel tank and is configured to discharge the fuel from the inside of the fuel tank toward the internal combustion engine.

The coupling stay of the device of the patent literature 1 includes a first slide member, which extends on a lower side of the cover body, and a second slide member, which is installed to the pump unit and is slidably fitted in a top-top-to-bottom direction relative to the first slide member.

However, in the device of the patent literature 1, the fuel tank expands and contracts in response to repeating of operation and stop of the internal combustion engine, so that the cover body and the pump unit follow the expansion and contraction of the upper wall and the bottom wall of the fuel tank. Therefore, when the expansion and contraction of the fuel tank become excessive, an excessive load is exerted along the coupling stay to the cover body, and thereby breakage of the cover body may possibly occur. In a case where the cover body is broken, fuel vapor may leak from the fuel tank. Therefore, the breakage of the cover body is not desirable.

CITATION LIST

Patent Literature

PATENT LITERATURE 1: JP2012-184760A

SUMMARY OF INVENTION

The present disclosure is made in view of the above disadvantage, and it is an objective of the present disclosure to provide a fuel supply device that limits breakage of a cover body.

In order to achieve the above objective, according to a first aspect of the present disclosure, there is provided a fuel supply device configured to supply fuel from an inside of a fuel tank to an internal combustion engine, including:

a cover body that is configured to be installed to an upper wall of the fuel tank;

a pump unit that is configured to be placed on a bottom wall of the fuel tank and is configured to discharge the fuel from the inside of the fuel tank toward the internal combustion engine; and a coupling stay that couples between the cover body and the pump unit, wherein:

the coupling stay includes:

an upper stay that extends on a lower side of the cover body; and a lower stay that is installed to the pump unit and is slidably fitted to the upper stay in a top-to-bottom direction; and a stress concentrating portion, which reduces a section modulus to concentrate a stress around the stress concentrating portion, is formed at a specific location of the lower stay.

At the coupling stay of the first aspect, the lower stay, which is installed to the pump unit, is slidably fitted to the upper stay in the top-to-bottom direction while the upper stay extends on the lower side of the cover body. According to the first aspect, in which the stress concentrating portion is formed at the specific location of the lower stay, when an excessive load is exerted along the coupling stay in response to excessive expansion and contraction of the fuel tank, the stress concentrating portion, which reduces the section modulus to concentrate the stress around the stress concentrating portion, is broken first with higher priority over the cover body. Therefore, due to the prioritized breakage of the lower stay, which is farther spaced from the cover body in comparison to the upper stay, it is possible to limit a breakage of the cover body that would result in fuel vapor leakage from the fuel tank.

In order to achieve the above objective, according to a second aspect of the present disclosure, there is provided a fuel supply device configured to supply fuel from an inside of a fuel tank to an internal combustion engine, including:

a cover body that is configured to be installed to an upper wall of the fuel tank;

a pump unit that is configured to be placed on a bottom wall of the fuel tank and is configured to discharge the fuel from the inside of the fuel tank toward the internal combustion engine; and a coupling stay that couples between the cover body and the pump unit, wherein:

the coupling stay includes:

an upper stay that extends on a lower side of the cover body; and a lower stay that is installed to the pump unit and is slidably fitted to the upper stay in a top-to-bottom direction; and a stress concentrating portion, which reduces a cross-sectional area to concentrate a stress around the stress concentrating portion, is formed at a specific location of the lower stay.

At the coupling stay of the second aspect, the lower stay, which is installed to the pump unit, is slidably fitted to the upper stay in the top-to-bottom direction while the upper stay extends on the lower side of the cover body. According to the second aspect, in which the stress concentrating portion is formed at the specific location of the lower stay, when an excessive load is exerted along the coupling stay in response to excessive expansion and contraction of the fuel tank, the stress concentrating portion, which reduces the cross-sectional area to concentrate the stress around the stress concentrating portion, is broken first with higher priority over the cover body. Therefore, due to the prioritized breakage of the lower stay, which is farther spaced from the cover body in comparison to the upper stay, it is possible to limit a breakage of the cover body that would result in fuel vapor leakage from the fuel tank.

The stress concentrating portion according to a third aspect of the present disclosure is formed at the specific location that is located immediately above a lower end part of the lower stay that receives a load from the bottom wall. According to the third aspect, when the fuel tank is excessively expanded and contracted, the stress tends to concentrate at the stress concentrating portion, at which the section modulus or the cross-sectional area is reduced, at the specific location of the lower stay, which is placed immediately above the lower end part that receives the excessive load from the bottom wall of the fuel tank. Accordingly, the breakage of the lower stay, which is prioritized over the cover body, can be reliably induced, so that a damage limiting effect for limiting the damage of the cover body can be increased.

In the device disclosed in the patent literature 1, two rail segments, which are laterally placed side by side in a lower stay, are respectively slidably fitted to two guide segments, which are laterally placed side by side in an upper stay, in the top-to-bottom direction. Positions of lower end parts of these two guide segments coincide with each other in the top-to-bottom direction, and positions of upper end parts of these two rail segments also coincide with each other in the top-to-bottom direction. Therefore, a fitting initial position of one of the rail segments relative to one of the guide segments do not substantially deviate from a fitting initial position of the other one of the rail segments relative to the other one of the guide segments. Specifically, at the time of assembling the lower stay to the upper stay, the fitting of the one rail segment to the one guide segment and the fitting of the other rail segment to the other guide segment need to start simultaneously. Therefore, positioning of the one rail segment to the one guide segment and positioning of the other rail segment to the other guide segment need to be substantially simultaneously performed at the two lateral sides, respectively. This may result in a reduction in the productivity.

According to a fourth aspect of the present disclosure, which addresses the above disadvantage:

the upper stay includes a first upper segment and a second upper segment that are laterally placed side by side and are integrally formed in one piece;

the lower stay includes a first lower segment and a second lower segment that are laterally placed side by side and are integrally formed in one piece;

the first lower segment is slidably fitted to the first upper segment in the top-top-to-bottom direction from a first fitting initial position; and the second lower segment is slidably fitted to the second upper segment in the top-to-bottom direction from a second fitting initial position, at which the slide fitting of the first lower segment relative to the first upper segment is further advanced in comparison to the first fitting initial position.

According to the fourth aspect, at the second fitting initial position where the second lower segment is slidably fitted to the second upper segment, the slide fitting of the first lower segment relative to the first upper segment is further advanced in comparison to the first fitting initial position where the first lower segment is slidably fitted to the first upper segment. Therefore, at the time of assembling the lower stay, in which the first lower segment and the second lower segment are integrally formed, to the upper stay, in which the first upper segment and the second upper segment are integrally formed, the timing of the slide fitting of the first lower segment to the first upper segment and the timing of the slide fitting of the second lower segment to the second upper segment are deviated from each other. Specifically, the first lower segment is slidably fitted to the first upper segment from the first fitting initial position, and thereafter the second lower segment is slidably fitted to the second upper segment from the second fitting initial position.

According to the fourth aspect, the first lower segment is positioned relative to the first upper segment at the first fitting initial position, and thereafter, the slide fitting of the first lower segment relative to the first upper segment is advanced. Thereby, the relative displacement in the transverse direction between the lower stay and the upper stay can be limited. Thus, while the first lower segment is guided by the first upper segment, the second lower segment can be positioned relative to the second upper segment at the second fitting initial position. As discussed above, not only the positioning at the first fitting initial position can be easily achieved solely at the one side in the transverse direction, but also the positioning at the second fitting initial position can be easily achieved at the opposite side, which is opposite from the one side in the transverse direction. As a result, it is possible to improve the work efficiency with respect to the assembling of the lower stay to the upper stay, and thereby it is possible to improve the productivity.

BRIEF DESCRIPTION OF DRAWINGS

The present disclosure, together with additional objectives, features and advantages thereof, will be best understood from the following description in view of the accompanying drawings.

DESCRIPTION OF EMBODIMENTS

Hereinafter, various embodiments of the present disclosure will be described with reference to the drawings. In the following respective embodiments, corresponding structural elements are indicated by the same reference signs and may not be redundantly described in some cases. In a case where only a part of a structure is described in each of the following embodiments, the rest of the structure of the embodiment may be the same as that of previously described one or more of the embodiments. Besides the explicitly described combination(s) of structural components in each of the following embodiments, the structural components of different embodiments may be partially combined even though such a combination(s) is not explicitly described as long as there is no problem.

First Embodiment

Figure 1:
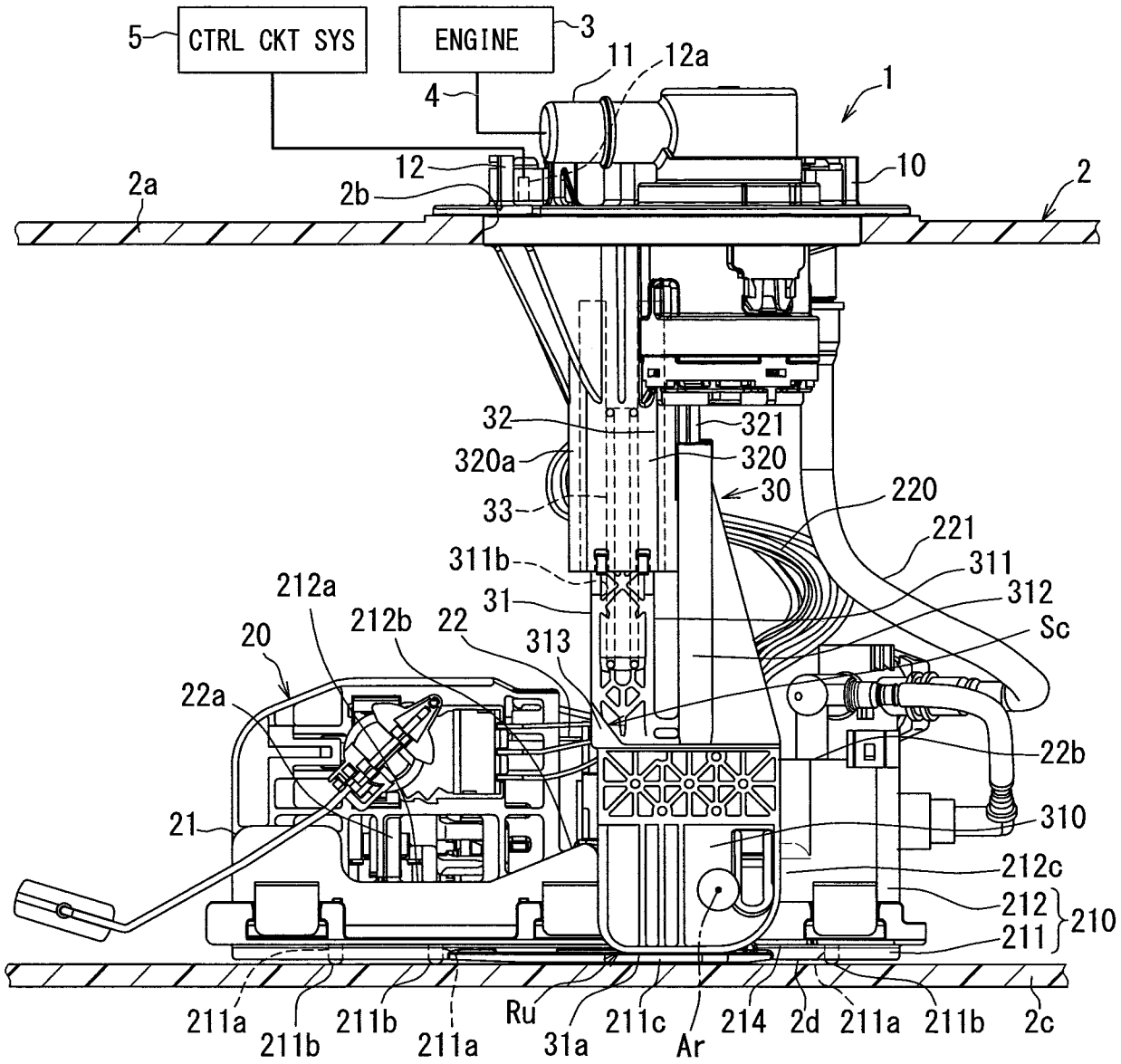
FIG. 1 is a front view of a fuel supply device according to a first embodiment of the present disclosure.

As shown in FIG. 1, a fuel supply device 1 according to a first embodiment of the present disclosure is installed to a fuel tank 2 and is thereby applied to an internal combustion engine 3 of a vehicle. The fuel supply device 1 supplies fuel, which is stored in the fuel tank 2, to the internal combustion engine 3 located at an outside of the fuel tank 2. Here, the fuel tank 2 is made of resin or metal and is shaped into a hollow form. An insertion hole 2*b* extends through an upper wall 2*a* of the fuel tank 2. The fuel supply device 1 is inserted into an inside of the fuel tank 2 through the insertion hole 2*b*. Under the above-described inserted state, the internal combustion engine 3, which is a supply destination of the fuel from the fuel supply device 1, may be a gasoline engine or a diesel engine. A top-to-bottom direction and a transverse direction of FIGS. 1 to 3, which show the inserted state of the fuel supply device 1 in the fuel tank 2, are respectively defined to correspond with a vertical direction and a horizontal direction of the vehicle placed on a horizontal plane.

(Overall Structure)

Figure 2:
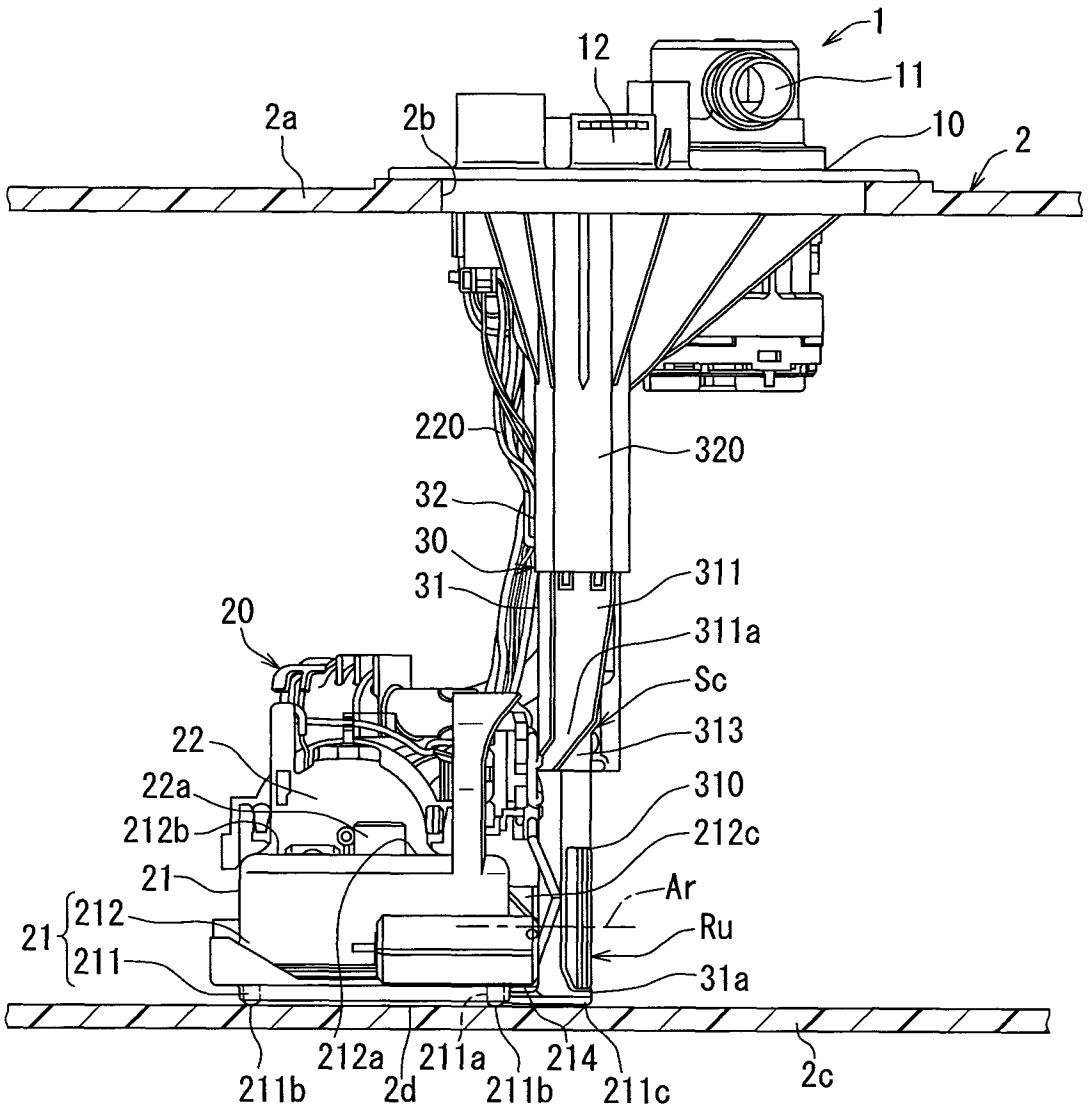
FIG. 2 is a left side view of the fuel supply device according to the first embodiment.
Figure 3:
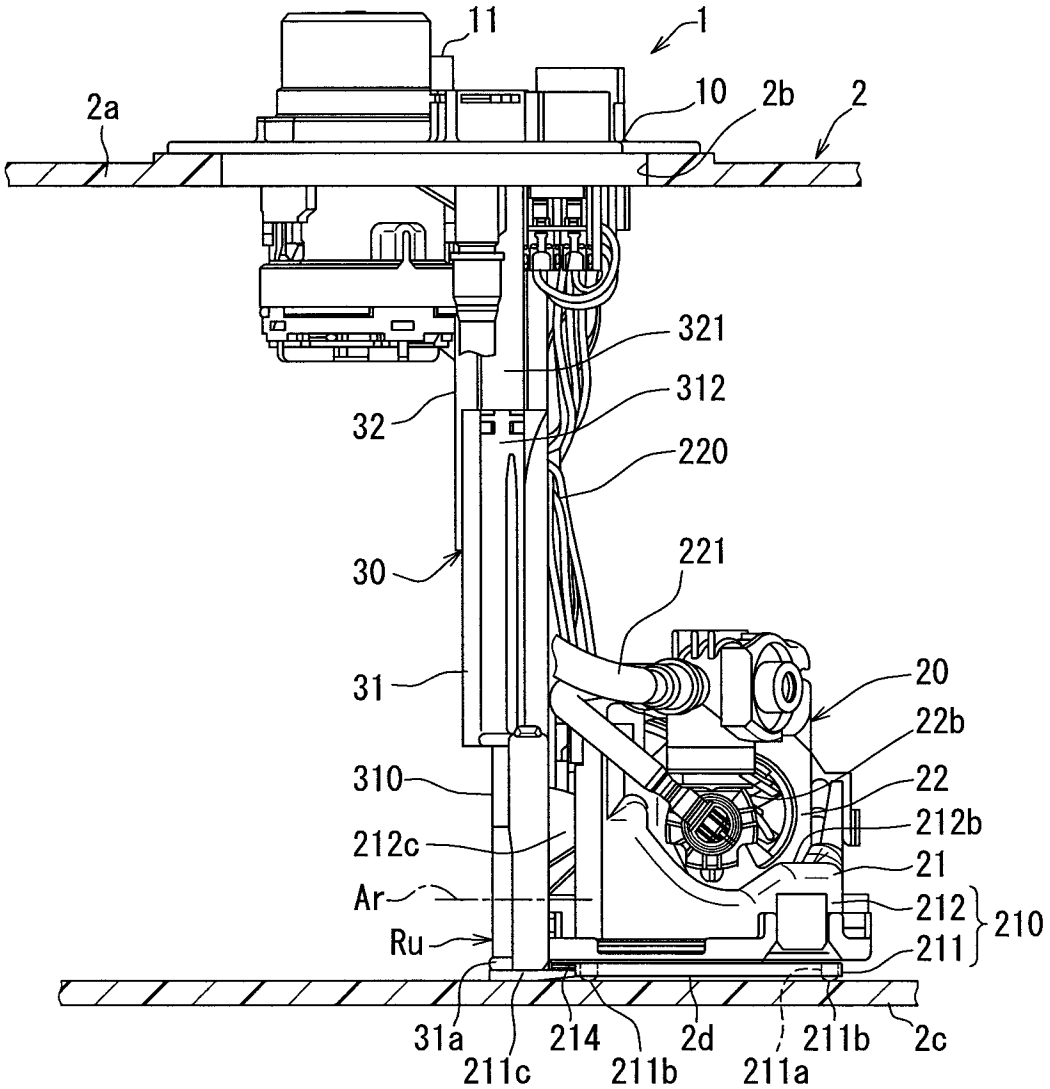
FIG. 3 is a right side view of the fuel supply device according to the first embodiment.

First of all, an overall structure of the fuel supply device 1 will be described. As shown in FIGS. 1 to 3, the fuel supply device 1 includes a cover body 10, a pump unit 20 and a coupling stay 30.

The cover body 10 is made of resin and is shaped into a circular plate form. The cover body 10 is installed to an upper wall 2*a* of the fuel tank 2. With this installation, the cover body 10 closes the insertion hole 2*b*. The cover body 10 integrally has a fuel supply pipe 11 and an electrical connector 12. The fuel supply pipe 11 is communicated with the pump unit 20 in the inside of the fuel tank 2. As shown in FIG. 1, the fuel supply pipe 11 is communicated with a fuel path 4 that extends from the fuel tank 2 to the internal combustion engine 3 at the outside of the fuel tank 2. Under this communicating state, when the pump unit 20 discharges the fuel, which is suctioned from the inside of the fuel tank 2, toward the internal combustion engine 3 located at the outside of the fuel tank 2, the discharged fuel is supplied from the fuel supply pipe 11 to the internal combustion engine 3 through the fuel path 4.

The electrical connector 12 receives a plurality of metal terminals 12*a*. Each metal terminal 12*a* is electrically connected to a fuel pump 22 of the pump unit 20 in the inside of the fuel tank 2. The metal terminals 12*a* are electrically connected to a control circuit system 5, such as an ECU, at the outside of the fuel tank 2. Under this electrically connected state, an operation of the fuel pump 22 is controlled based on a control signal(s) outputted from the control circuit system 5 through the respective metal terminals 12*a*.

As shown in FIGS. 1 to 3, the pump unit 20 is placed on the lower side of the cover body 10 in the inside of the fuel tank 2. The pump unit 20 includes a unit main body 21 and the fuel pump 22. The unit main body 21 is shaped into a flat rectangular box form as a whole and is placed on a bottom wall 2*c* of the fuel tank 2. A sub-tank 210 of the unit main body 21 includes a lower member 211 and an upper member 212, which are assembled together to form the sub-tank 210.

The lower member 211 is made of resin and is shaped into a flat plate form. A plurality of inflow holes 211*a* extends through the lower member 211 in the top-to-bottom direction. A plurality of projections 211*b* downwardly projects from the lower member 211. Each projection 211*b* contacts the bottom wall 2*c* of the fuel tank 2 from the upper side of the bottom wall 2*c*, so that an inflow gap 2*d* is formed between the lower member 211 and the bottom wall 2*c*. The fuel in the fuel tank 2 flows into each inflow hole 211*a* through the inflow gap 2*d*.

The upper member 212 is made of resin and is shaped into an inverted cup form. An outer periphery of the upper member 212 is fixed to an outer periphery of the lower member 211. A through-hole 212*a* extends through the upper member 212 in the top-to-bottom direction. The fuel in the fuel tank 2 flows into an inside of the upper member 212 through the through-hole 212*a* and is stored in the sub-tank 210.

A filter screen 214 of the unit main body 21 is made of a material, such as a porous resin, a woven fabric, an unwoven fabric, a resin mesh or a metal mesh, which has a filtering function. The filter screen 214 is shaped into a flat rectangular bag form. An outer periphery of the filter screen 214 is clamped between the lower member 211 and the upper member 212. Under this clamped state, the fuel, which flows from the inside of the fuel tank 2 into the respective inflow holes 211*a* and the inside of the upper member 212, is filtered through the filter screen 214. The filtered fuel is suctioned from the inside of the filter screen 214 into the fuel pump 22.

The fuel pump 22 is, for example, an electric pump, such as a vane pump or a trochoid pump. The fuel pump 22 is shaped into a cylindrical form that is oriented to extend in the transverse direction. The fuel pump 22 is fixed to an upper portion 212*b* of the upper member 212 of the unit main body 21. The fuel pump 22 is electrically connected to each of the metal terminals 12*a* through a flexible wiring 220 that is flexible. A suction port 22*a* of the fuel pump 22 is inserted into the inside of the upper member 212 through the through-hole 212*a* and is communicated with the inside of the filter screen 214 that is shaped into the bag form. A discharge port 22*b* of the fuel pump 22 is communicated with the fuel supply pipe 11 through a flexible tube 221 that is flexible. The fuel pump 22 is driven according to the control signal outputted from the control circuit system 5, so that the fuel pump 22 suctions the filtered fuel that is present in the inside of the filter screen 214. The fuel pump 22 discharges the suctioned fuel toward the internal combustion engine 3.

The coupling stay 30 is received in the inside of the fuel tank 2. The coupling stay 30 solely couples between the cover body 10 and the pump unit 20. The pump unit 20 is installed to the coupling stay 30 such that the pump unit 20 is rotatable about a rotational axis Ar that is assumed to extend in the transverse direction. Under this installed state, rotational positions of the pump unit 20 relative to the coupling stay 30 about the rotational axis Ar includes an operating rotational position Ru shown in FIGS. 1 to 3 and a reference rotational position Rb shown in FIGS. 4 and 5.

Figure 4:
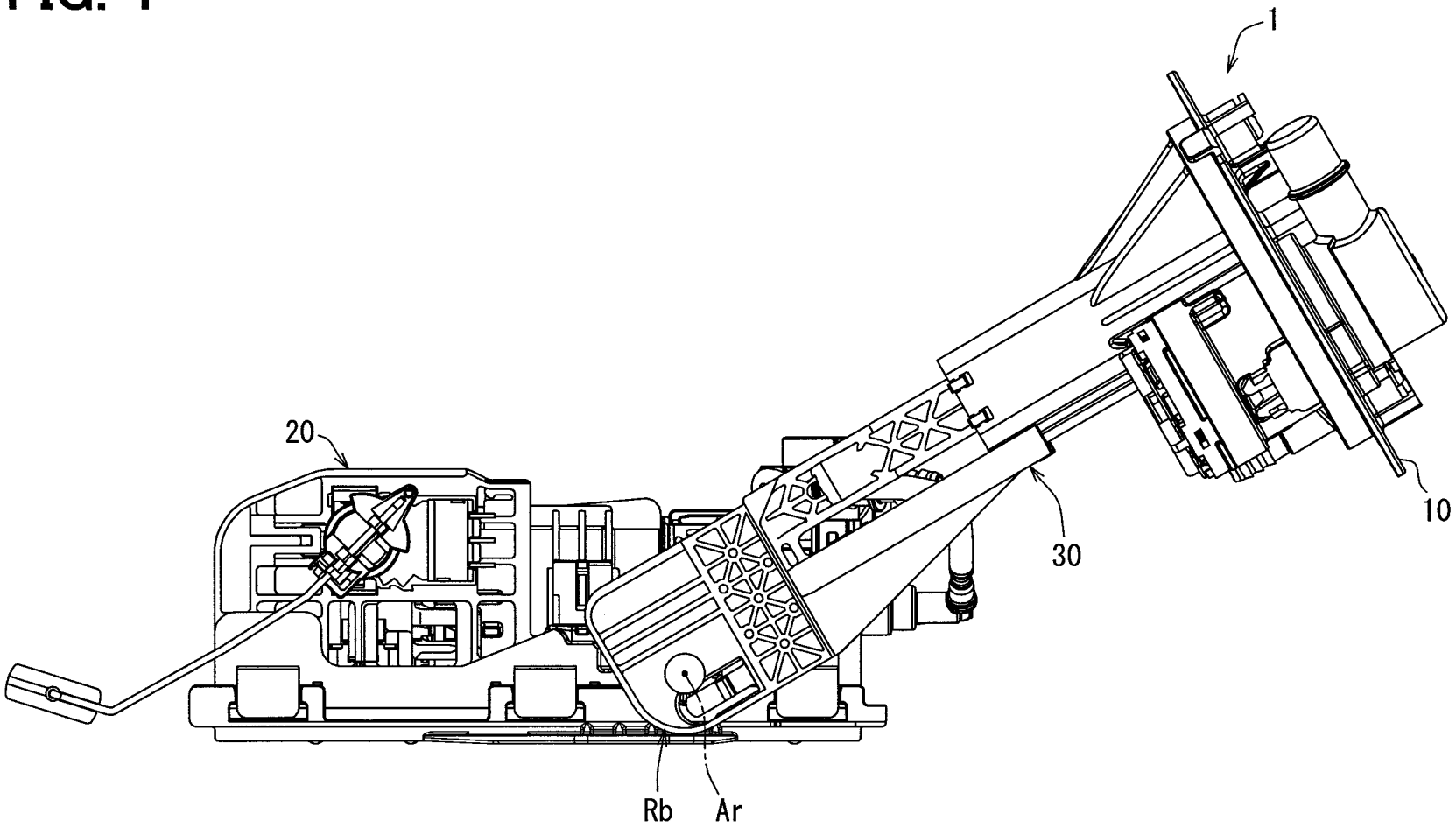
FIG. 4 is a front view showing a state of the fuel supply device that is different from the state of the fuel supply device shown in FIG. 1 according to the first embodiment.
Figure 5:
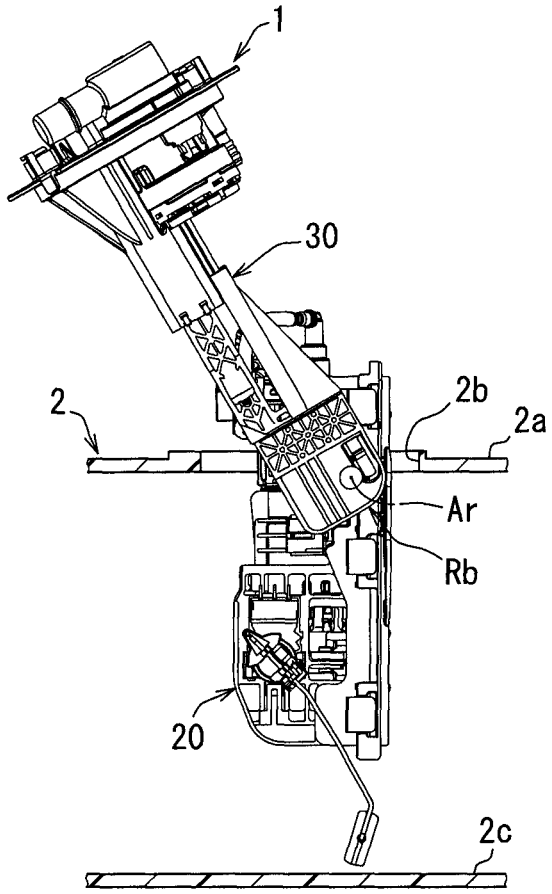
FIG. 5 is a schematic diagram showing an inserting method of the fuel supply device into a fuel tank according to the first embodiment.

Specifically, the operating rotational position Ru is a rotational position of the pump unit 20 where the pump unit 20 is bent generally at a right angle relative to the coupling stay 30, which extends in the top-to-bottom direction in the inserted state of the fuel supply device 1 that is inserted into the inside of the fuel tank 2, as shown in FIGS. 1 to 3, so that the pump unit 20 is placed on the bottom wall 2*c* of the fuel tank 2. In contrast, the reference rotational position Rb is a rotational position of the pump unit 20 where the pump unit 20 is less bent relative to the coupling stay 30 in comparison to the operating rotational position Ru before inserting the fuel supply device 1 into the inside of the fuel tank 2, as shown in FIG. 4. At the reference rotational position Rb, as shown in FIG. 5, the entire fuel supply device 1 can be inserted from the pump unit 20 side into the fuel tank 2 through the insertion hole 2*b*.

As shown in FIGS. 1 to 3, the coupling stay 30 includes a lower stay 31, an upper stay 32 and a resilient member 33. The lower stay 31 is placed at a lateral side of the pump unit 20 and extends in the top-to-bottom direction. The lower stay 31 includes a rotatable plate segment 310, a lower column segment 311 and a lower tube segment 312. The rotatable plate segment 310, the lower column segment 311 and the lower tube segment 312 are integrally formed in one piece from resin.

The rotatable plate segment 310 is shaped into a flat plate form that extends in both the top-to-bottom direction and the transverse direction. The rotatable plate segment 310 is installed to a lateral portion 212*c* of the upper member 212 of the unit main body 21 of the pump unit 20 such that the rotatable plate segment 310 is rotatable relative to the lateral portion 212*c* about the rotational axis Ar. A lowest end part of the rotatable plate segment 310 forms a lower end part 31*a* of the lower stay 31. Here, an intermediating portion 211*c*, which is in a flat plate form that extends in the transverse direction along the rotational axis Ar at the lower member 211, is formed at the unit main body 21. At the operating rotational position Ru shown in FIGS. 1 to 3, the intermediating portion 211*c* is interposed between the lower end part 31*a* of the lower stay 31 and the bottom wall 2*c* of the fuel tank 2. Due to this interposed state, the lower end part 31*a* of the lower stay 31 receives a load, which is generated through expansion and contraction of the fuel tank 2, from the bottom wall 2*c* through the intermediating portion 211*c*.

As shown in FIGS. 6 to 9, the lower column segment 311, which serves as a first lower segment, upwardly projects from the rotatable plate segment 310 of the lower stay 31, so that the lower column segment 311 is placed to extend in the top-to-bottom direction. A portion of the lower column segment 311, which is formed into a solid rectangular column form, forms a solid column portion 311*a* on a lower side of a receiving hole 311*b* that upwardly opens.

Figure 6:
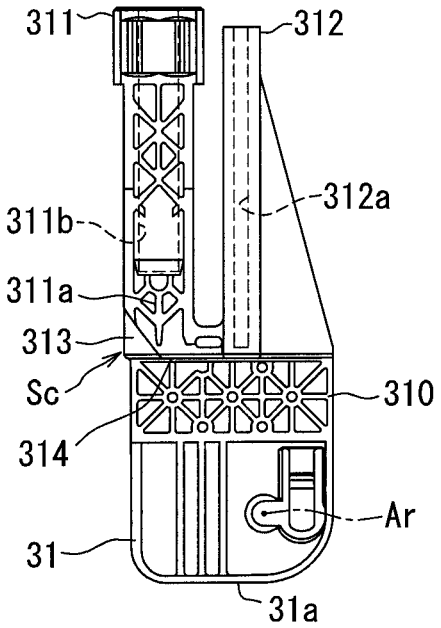
FIG. 6 is a front view of a lower stay shown in FIG. 1.
Figure 9:
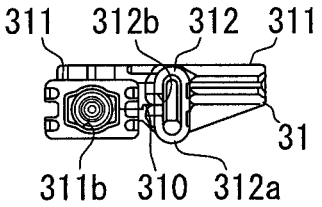
FIG. 9 is a top view of the lower stay shown in FIG. 1.

As shown in FIGS. 6 and 9, the lower tube segment 312, which serves as a second lower segment, upwardly projects from the rotatable plate segment 310 of the lower stay 31 such that the lower tube segment 312 is placed to extend substantially parallel with the lower column segment 311 in the top-to-bottom direction. The lower tube segment 312 is spaced from the lower column segment 311 in the transverse direction. The lower tube segment 312 is shaped into a rectangular hollow tubular form that upwardly opens such that the lower tube segment 312 forms a hollow tubular portion 312*a* as a whole.

Figure 7:
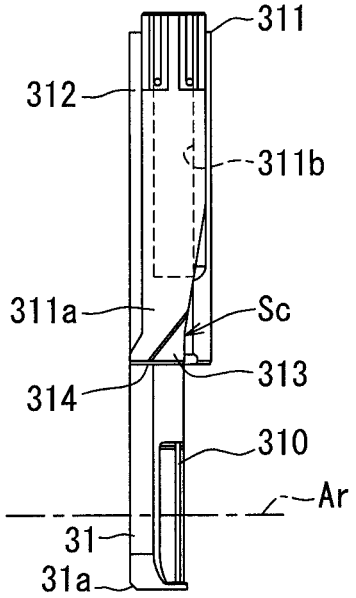
FIG. 7 is a left side view of the lower stay shown in FIG. 1.
Figure 8:
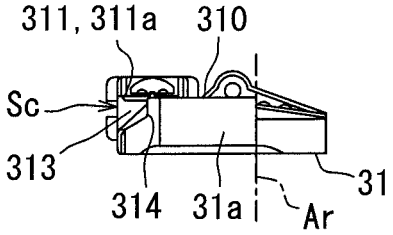
FIG. 8 is a bottom view of the lower stay shown in FIG. 1.

As shown in FIGS. 1, 2 and 6 to 8, in the lower stay 31, a stress concentrating portion 313 is formed at a specific location Sc of the lower column segment 311, which is located immediately above the lower end part 31*a*. Here, as shown in FIGS. 6 to 8, the specific location Sc is set in a range that is from a boundary 314, which is between the rotatable plate segment 310 and the solid column portion 311*a*, to a location that is upwardly spaced from the boundary 314 by a predetermined distance in the solid column portion 311*a* of the lower column segment 311.

The stress concentrating portion 313, which is formed at the specific location Sc, is in a form of an oblique cut at the solid column section 311*a* of the lower column segment 311 in the lower stay 31. Specifically, the stress concentrating portion 313 is obliquely tilted toward the boundary 314 relative to both of the transverse direction, which is along the rotational axis Ar, and the transverse direction, which is perpendicular to the rotational axis Ar.

Figure 13:
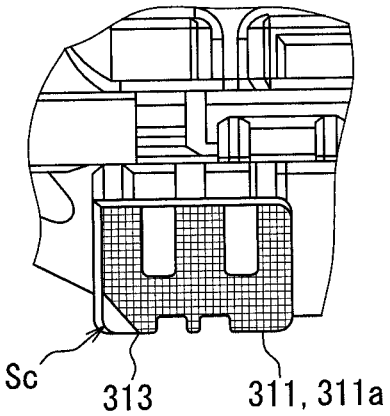
FIG. 13 is a schematic diagram corresponding to a cross sectional view taken along line XIII-XIII in FIG. 12.
Figure 14:
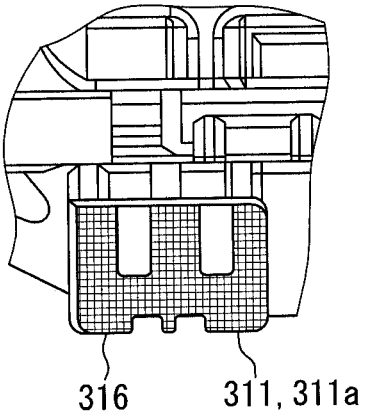
FIG. 14 is a schematic diagram corresponding to a cross sectional view taken along line XIV-XIV in FIG. 12.

Due to this tilting configuration toward the boundary 314, at the stress concentrating portion 313 in the specific location Sc of the solid column portion 311*a*, a section modulus, which is measured at a cross section (see, for example, a crosshatching area of FIG. 13) that is substantially parallel to the rotational axis Ar, is reduced in comparison to a section modulus, which is measured at a cross section (see, for example, a crosshatching area of FIG. 14) of another portion 316 of the solid column portion 311*a* that is substantially parallel to the rotational axis Ar. Thereby, at the operating rotational position Ru shown in FIGS. 1 and 2, when the lower stay 31 receives a load, which is generated by the expansion and contraction of the fuel tank 2 and is exerted in a bending direction of the lower stay 31, a bending stress is concentrated at the stress concentrating portion 313 where the section modulus is reduced. Here, since the bending stress is obtained by dividing the bending moment by the section modulus, the bending stress increases as the section modulus decreases. In the present embodiment, the section modulus is given with respect to, for example, a vertical direction and a lateral direction of the cross sections of FIGS. 13, 14.

Furthermore, at the stress concentrating portion 313, due to the tilting configuration toward the boundary 314, a cross sectional area of the cross section (see the crosshatching area shown in FIG. 13), which is substantially parallel to the rotational axis Ar, is reduced in comparison to a cross sectional area of the cross section (see, for example, the crosshatching area of FIG. 14) of the other portion 316 of the solid column portion 311*a* that is substantially parallel to the rotational axis Ar. Thereby, at the operating rotational position Ru shown in FIGS. 1 and 2, when the lower stay 31 receives a load, which is generated by the expansion and contraction of the fuel tank 2 and is applied in a compressing direction of the lower stay 31, a compressive stress is concentrated at the stress concentrating portion 313 where the cross sectional area is reduced.

As shown in FIGS. 1 to 3, the upper stay 32 extends on a lower side of the cover body 10. The upper stay 32 includes an upper tube segment 320 and an upper column segment 321. The upper tube segment 320 and the upper column segment 321 are integrally formed and are also integrally formed with the cover body 10 in one piece from resin.

Figure 10:
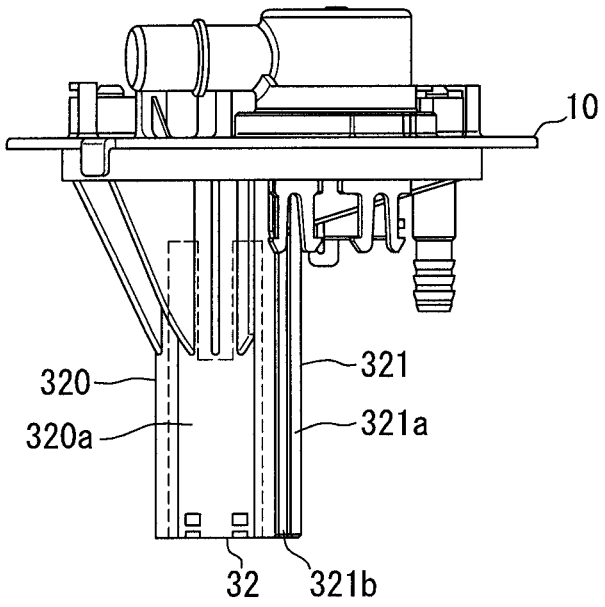
FIG. 10 is a front view of the upper stay shown in FIG. 1.
Figure 11:
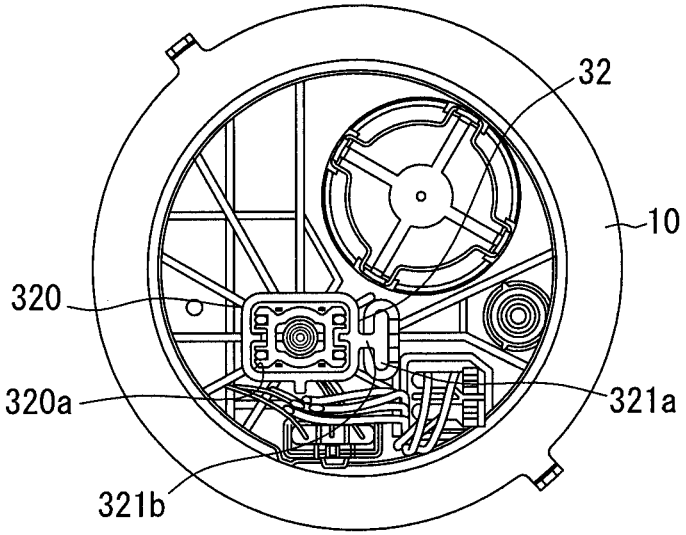
FIG. 11 is a bottom view of the upper stay shown in FIG. 1.

As shown in FIGS. 10 and 11, the upper tube segment 320, which serves as a first upper segment, extends in the top-to-bottom direction along the upper stay 32 that downwardly projects from the cover body 10. The upper tube segment 320 is shaped into a rectangular hollow tubular form that downwardly opens such that the upper tube segment 320 forms a hollow tubular portion 320*a* as a whole.

The upper column segment 321, which serves as a second upper segment, is placed to extend substantially in parallel with the upper tube segment 320 in the top-to-bottom direction at the upper stay 32 that downwardly projects from the cover body 10. Thereby, the upper column segment 321 is placed on the lateral side of the upper tube segment 320. The upper column segment 321 is shaped into a rectangular solid column form such that the upper column segment 321 forms a solid column portion 321*a* as a whole. The solid column portion 321*a* of the upper column segment 321 is joined to the hollow tubular portion 320*a* of the upper tube segment 320 in the transverse direction. With this joining configuration, a rib portion 321*b* of the solid column portion 321*a*, which is in a form of a rib and extends continuously from the hollow tubular portion 320*a*, reinforces the hollow tubular portion 320*a*.

Figure 12:
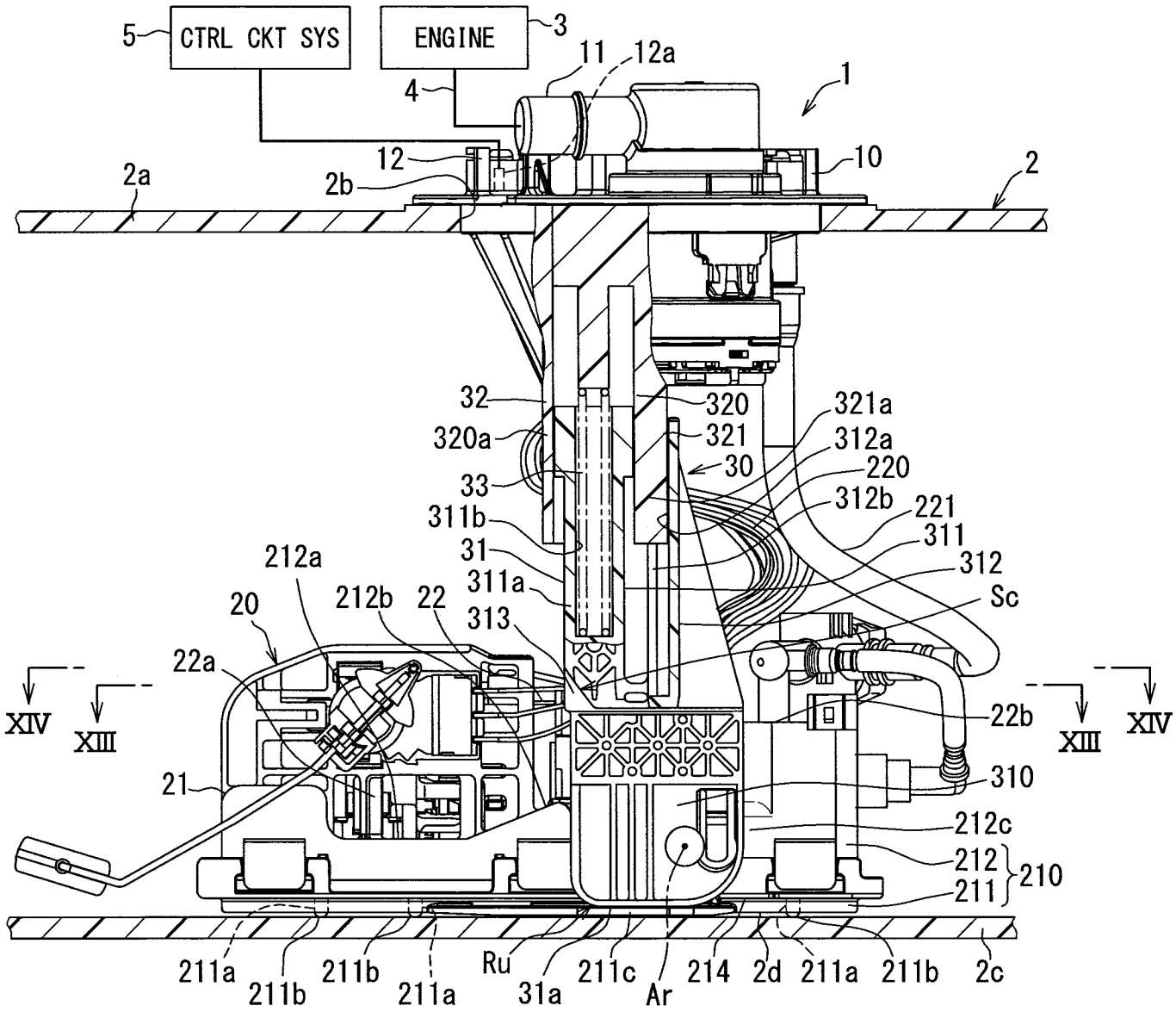
FIG. 12 is a partial cross-sectional view of the fuel supply device according to the first embodiment.

As shown in FIG. 12, the solid column portion 321*a* of the upper column segment 321, which is located on the upper side of the hollow tubular portion 312*a* of the lower tube segment 312 is slidably fitted into the hollow tubular portion 312*a*, so that the lower tube segment 312 is slidable relative to the upper column segment 321 in the top-to-bottom direction. Specifically, the solid column portion 321*a* of the upper column segment 321 is slidably fitted from the upper side into the hollow tubular portion 312*a* of the lower tube segment 312 in the top-to-bottom direction. Here, as shown in FIGS. 9 and 12, the rib portion 321*b*, which is formed at the solid column portion 321*a* of the upper column segment 321, is received in a slit 312*b* that is formed at the hollow tubular portion 312*a* of the lower tube segment 312.

As shown in FIG. 12, a portion of the lower column segment 311, which forms the receiving hole 311*b*, is slidably fitted into the hollow tubular portion 320*a* of the upper tube segment 320, so that the lower column segment 311 is slidable relative to the upper tube segment 320 in the top-to-bottom direction. Specifically, the portion of the lower column segment 311, which forms the receiving hole 311*b*, is slidably fitted from the lower side into the hollow tubular portion 320*a* of the upper tube segment 320 in the top-to-bottom direction.

Figure 15:
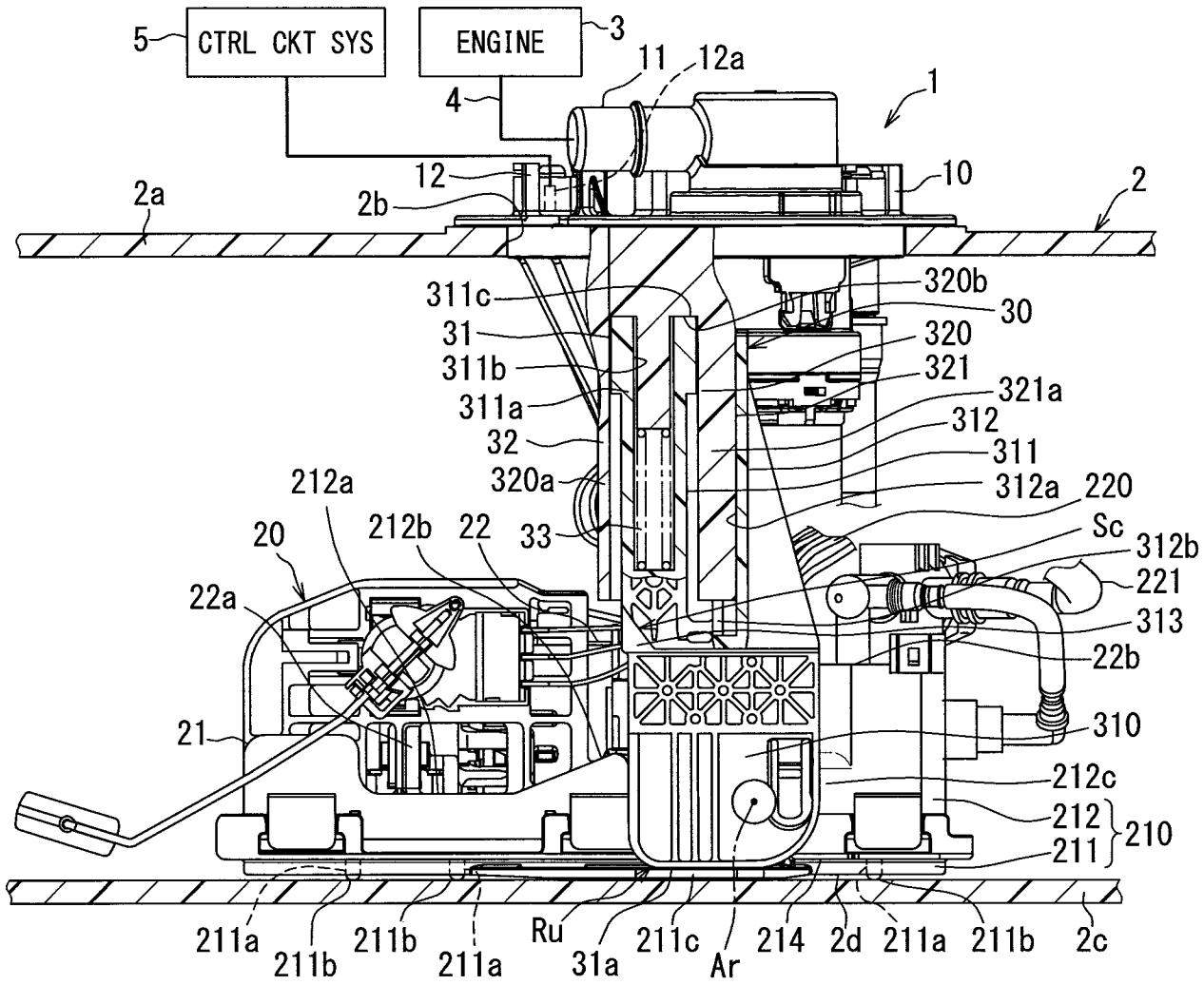
FIG. 15 is a partial cross-sectional view showing a state of the fuel supply device that is different from the state of the fuel supply device shown in FIG. 12 according to the first embodiment.

Here, as shown in FIG. 15, the lower column segment 311 is most deeply fitted into the inside of the hollow tubular portion 320*a*, so that a slide fit length of the lower stay 31 relative to the upper stay 32 (i.e., a fit length of the lower stay 31 that is slidably fitted to the upper stay 32) is maximized. At this time, a column-side upper end part 311*c* of the lower column segment 311 of the lower stay 31 is engaged to and is stopped by a recessed bottom surface 320*b* that is formed in the hollow tubular portion 320*a* of the upper stay 32.

Figure 16:
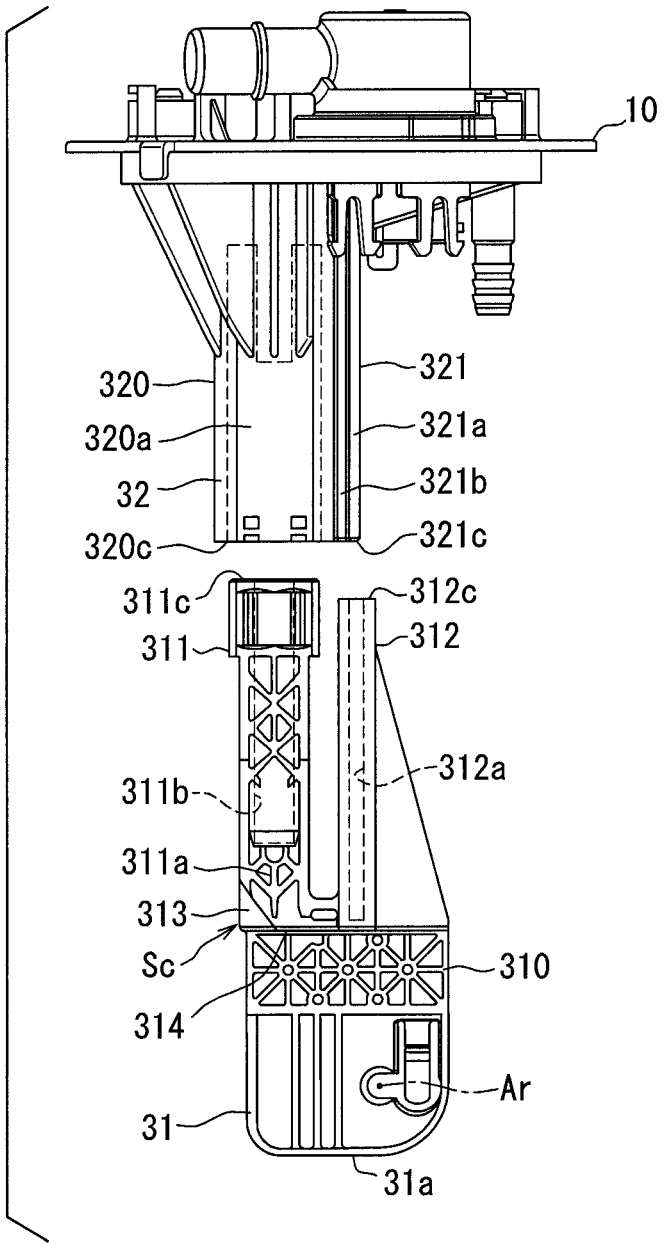
FIG. 16 is a front view showing a state of the fuel supply device that is different from the state of the fuel supply device shown in FIG. 1 according to the first embodiment.

As shown in FIG. 16, at the upper stay 32, a position of a tube-side lower end part (serving as a first lower end part) 320*c* of the upper tube segment 320 coincides with a position of a column-side lower end part (serving as a second lower end part) 321*c* of the upper column segment 321 in the top-to-bottom direction, so that the position of the tube-side lower end part 320*c* is not substantially displaced from the position of the column-side lower end part 321*c* in the top-to-bottom direction. In contrast, at the lower stay 31, the column-side upper end part (serving as a first upper end part) 311*c* of the lower column segment 311 is upwardly spaced from a tube-side upper end part (serving as a second upper end part) 312*c* of the lower tube segment 312 such that the column-side upper end part 311*c* is displaced stepwise relative to the tube-side upper end part 312*c*. Specifically, the column-side upper end part 311*c* is an upper end part of the lower stay 31 that is placed at an uppermost location at the lower stay 31.

Figure 17:
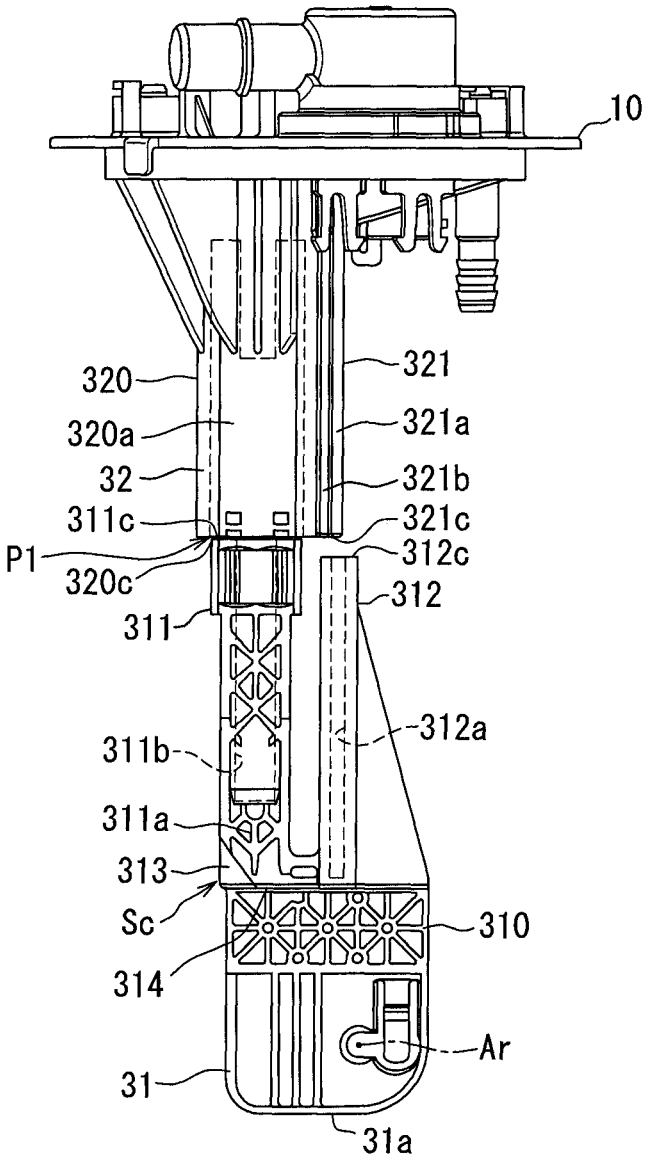
FIG. 17 is a front view showing a state of the fuel supply device that is different from the states of the fuel supply device respectively shown in FIGS. 1 and 16 according to the first embodiment.

Under the above-described end part positional relationship, the lower column segment 311 is slidably fitted into the upper tube segment 320 from a first fitting initial position P1 shown in FIG. 17 in the top-to-bottom direction. Specifically, the first fitting initial position P1 is an initial position, at which the column-side upper end part 311*c* of the lower column segment 311 begins the slide fitting relative to the tube-side lower end part 320*c* of the upper tube segment 320. In contrast, the lower tube segment 312 is slidably fitted to the upper column segment 321 in the top-to-bottom direction from a second fitting initial position P2 shown in FIG. 18. Specifically, the second fitting initial position P2 is an initial position, at which the tube-side upper end part 312*c* of the lower tube segment 312 begins the slide fitting relative to the column-side lower end part 321*c* of the upper column segment 321. Furthermore, the second fitting initial position P2 is a position, at which the slide fitting of the lower column segment 311 relative to the upper tube segment 320 is further advanced in comparison to the first fitting initial position P1 shown in FIG. 17.

As shown in FIGS. 1, 12 and 15, the stress concentrating portion 313 is formed at the specific location Sc that is located in the solid column portion 311*a* of the lower column segment 311 and is placed at the outside of the hollow tubular portion 320*a* of the upper tube segment 320. Here, particularly in the present embodiment, the stress concentrating portion 313 is set at the location where even when the lower column segment 311 is most deeply inserted into the hollow tubular portion 320*a* within a range, in which the lower column segment 311 can resist against a restoring force of the resilient member 33 described later in detail, the stress concentrating portion 313 is still placed at the outside of the hollow tubular portion 320*a*, as shown in FIG. 15. In other words, even when the slide fit length of the lower stay 31 relative to the upper stay 32 is maximized, as shown in FIG. 15, the stress concentrating portion 313 is still placed at the outside of the hollow tubular portion 320*a*.

As shown in FIGS. 1 and 12, the resilient member 33 is made of metal and is in a form of a coil spring. The resilient member 33 is received such that the resilient member 33 extends in both of the inside of the hollow tubular portion 320*a* of the upper tube segment 320 and the inside of the receiving hole 311*b* of the lower column segment 311. The resilient member 33 is clamped between the hollow tubular portion 320*a* and the receiving hole 311*b*. With this clamping configuration, in the state where the resilient member 33 is engaged to the upper tube segment 320, the resilient member 33 exerts the restoring force against the lower column segment 311 in a downward direction that is a direction toward the bottom wall 2*c* of the fuel tank 2. This restoring force is transmitted from the lower column segment 311 to the pump unit 20 through the rotatable plate segment 310, so that each of the projections 211*b* of the unit main body 21 is urged against the bottom wall 2*c* of the fuel tank 2. Therefore, in the coupling stay 30, the slide fit position between the lower stay 31 and the upper stay 32 changes in response to the expansion and contraction of the fuel tank 2.

[Effects and Advantages]

Effects and advantages of the first embodiment discussed above will be described hereinafter.

Figure 19:
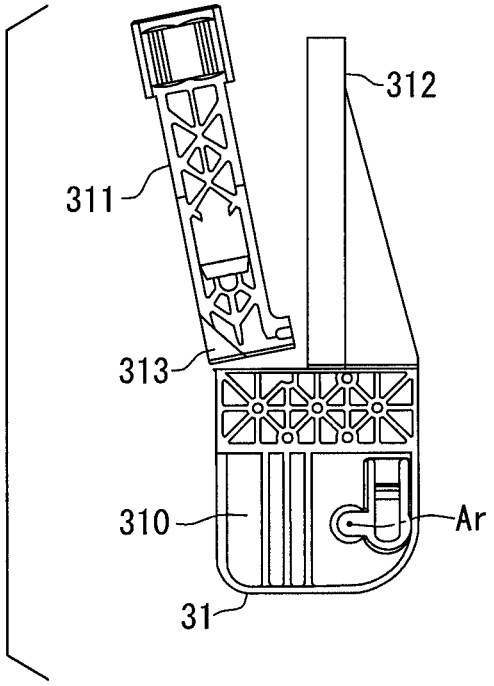
FIG. 19 is a schematic diagram for describing effects and advantages of the fuel supply device of the first embodiment.
Figure 20:
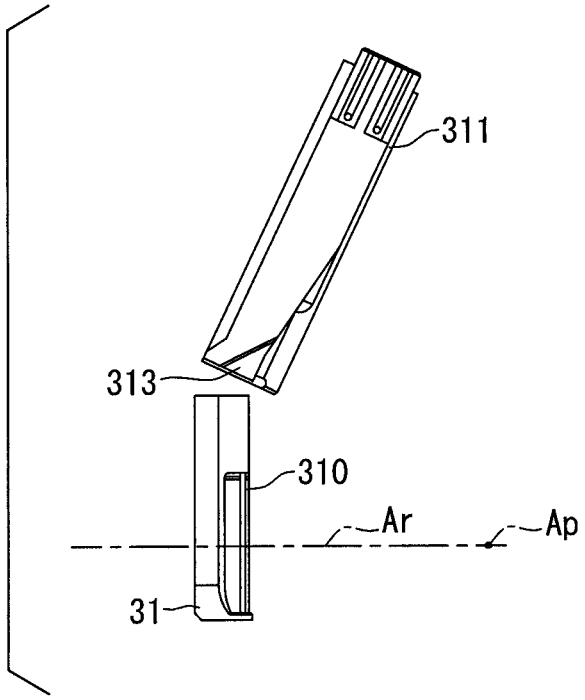
FIG. 20 is a schematic diagram for describing effects and advantages of the fuel supply device of the first embodiment.

At the coupling stay 30 of the first embodiment, the lower stay 31, which is installed to the pump unit 20, is slidably fitted to the upper stay 32 in the top-to-bottom direction while the upper stay 32 extends on the lower side of the cover body 10. According to the first embodiment, in which the stress concentrating portion 313 is formed at the specific location Sc of the lower stay 31, when an excessive load is exerted along the coupling stay 30 in response to excessive expansion and contraction of the fuel tank 2, the stress concentrating portion 313, which reduces the section modulus and the cross-sectional area to concentrate the stress around the stress concentrating portion 313, may be broken first with higher priority over the cover body 10, as shown in FIGS. 19 and 20. Therefore, due to the prioritized breakage of the lower stay 31, which is farther spaced from the cover body 10 in comparison to the upper stay 32, it is possible to limit a breakage of the cover body 10 that would result in fuel vapor leakage from the fuel tank 2. FIG. 19 exemplary shows a state where the stress concentrating portion 313 of the lower column segment 311 is broken to tilt about the rotational axis Ar and is thereby separated from the rotatable plate segment 310 and the lower tube segment 312. In contrast, FIG. 20 exemplary shows another state where the stress concentrating portion 313 is broken to tilt about a perpendicular axis Ap that is perpendicular to the rotational axis Ar, so that the stress concentrating portion 313 is separated from the rotatable plate segment 310 and the lower tube segment 312.

Furthermore, in the first embodiment, when the fuel tank 2 is excessively expanded and contracted, the stress tends to concentrate at the stress concentrating portion 313 of the lower stay 31, at which the section modulus and the cross-sectional area are reduced, at the specific location Sc, which is placed immediately above the lower end part 31*a* that receives the excessive load from the bottom wall 2*c* of the fuel tank 2. Accordingly, the breakage of the lower stay 31, which is prioritized over the cover body 10, can be reliably induced, so that a damage limiting effect for limiting the damage of the cover body 10 can be increased.

Furthermore, according to the first embodiment, in the structure, in which the lower stay 31 is slidably fitted into the upper stay 32 from the lower side of the upper stay 32, the stress concentrating portion 313 is formed at the specific location Sc of the lower stay 31, which is placed at the outside of the upper stay 32. Thereby, the breakage of the lower stay 31 is generated at the outside of the upper stay 32. Here, in a case where the lower stay 31 is broken in the inside of the upper stay 32 to leave all of broken fragments in the inside of the upper stay 32, the excessive load, which is proportional to a degree of the excessive expansion and contraction of the fuel tank 2, is transmitted through the broken fragments in the top-to-bottom direction and is continuously applied to the cover body 10. However, when the lower stay 31 is designed to break at the outside of the upper stay 32, it is possible to limit the continuous application of the excessive load, which corresponds to the degree of the excessive expansion and contraction of the fuel tank 2, to the cover body 10. Thus, it is possible to enhance the damage limiting effect for limiting the damage of the cover body 10.

Furthermore, at the upper stay 32 of the first embodiment, the lower column segment 311 of the lower stay 31 is slidably fitted into the hollow tubular portion 320*a* of the upper tube segment 320 from the lower side of the hollow tubular portion 320*a*. Furthermore, in the lower stay 31, the upper column segment 321 of the upper stay 32 is slidably fitted into the hollow tubular portion 312*a* of the lower tube segment 312 in the top-to-bottom direction from the upper side of the hollow tubular portion 312*a*. At the above-described slide fit structure, in which the inside and outside relationship between the upper tube segment 320 and the lower column segment 311 is reversed relative to the inside and outside relationship between the upper column segment 321 and the lower tube segment 312, the stress concentrating portion 313 is formed at the specific location Sc of the lower column segment 311. Accordingly, a sum of strengths of the lower column segment 311 and the lower tube segment 312 is sufficiently ensured at the lower stay 31 against the expansion and contraction of the fuel tank 2, which are in a normal range, and the lower stay 31 can be broken at the stress concentrating portion 313 with the higher priority upon application of the excessive expansion and contraction of the fuel tank 2 to limit the breakage of the cover body 10.

In addition, the stress concentrating portion 313 of the first embodiment is formed in the specific location Sc of the solid column portion 311*a* in the lower column segment 311, so that a degree of reduction in the section modulus and a degree of reduction in the cross-sectional area can be freely set within a range of a contour of the solid column portion 311*a*. Specifically, a higher degree of design freedom with respect to the designing of the degree of reduction in the section modulus and the degree of reduction in the cross-sectional area is implemented, so that the stress concentrating portion 313 can have a suitable section modulus and a suitable cross-sectional area, which are suitable for the prioritized breakage of the lower stay 31 at the stress concentrating portion 313 in conformity with a specification of the fuel supply device 1 and a specification of the fuel tank 2.

Furthermore, in the first embodiment, the hollow tubular portion 320*a* of the upper tube segment 320 is reinforced by the solid column portion 321*a* of the upper column segment 321, which is continuous in the rib form with the hollow tubular portion 320*a*. Therefore, even when the excessive load is exerted along the coupling stay 30 in response to the excessive expansion and contraction of the fuel tank 2, the stress concentrating portion 313 of the lower stay 31 can be broken without breaking the hollow tubular portion 320*a* of the upper tube segment 320 in the upper stay 32. Accordingly, it is possible to limit breakage of the cover body 10 that would be otherwise caused by a broken fragment(s) of the upper stay 32, which is closer to the cover body 10 in comparison to the lower stay 31.

Furthermore, at the stress concentrating portion 313, which is in the form of the oblique cut in the lower stay 31 of the first embodiment, the section modulus and the cross-sectional area at the specific location Sc can be adjusted by changing the tilting configuration that is in the form of oblique cut. Accordingly, the damage limiting effect for limiting the damage of the cover body 10 can be enhanced by exercising the breaking function of the lower stay 31, which is prioritized over the cover body 10, at the time of occurrence of the excess expansion and contraction of the fuel tank 2.

Furthermore, according to the first embodiment, the column-side upper end part 311*c* of the lower stay 31 is engaged to and is stopped by the upper stay 32 when the slide fit length of the lower stay 31 relative to the upper stay 32 is maximized. Therefore, when the excessive load is exerted along the coupling stay 30 in response to the excessive expansion and contraction of the fuel tank 2, the slide fit length of the lower stay 31 relative to the upper stay 32 is maximized. Thereby, a shock is generated in response to the engagement of the column-side upper end part 311*c* to the upper stay 32. At this time, in the lower stay 31, at the stress concentrating portion 313, which reduces the section modulus and the cross-sectional area to concentrate the stress around the stress concentrating portion 313, the breakage can be generated with the higher priority over the cover body 10 regardless of the generation of the shock. Thus, it is possible to limit the breakage of the cover body 10.

In addition, according to the first embodiment, a significantly excessive load against the restoring force of the resilient member 33, which is clamped between the upper tube segment 320 and the lower column segment 311, may possibly be exerted to the upper tube segment 320 and the lower column segment 311 in response to the excessive expansion and contraction of the fuel tank 2. At this time, in the lower column segment 311, at the stress concentrating portion 313, which reduces the section modulus and the cross-sectional area to concentrate the stress around the stress concentrating portion 313, the breakage can be generated with the higher priority over the cover body 10. Thus, it is possible to limit the breakage of the cover body 10.

Figure 18:
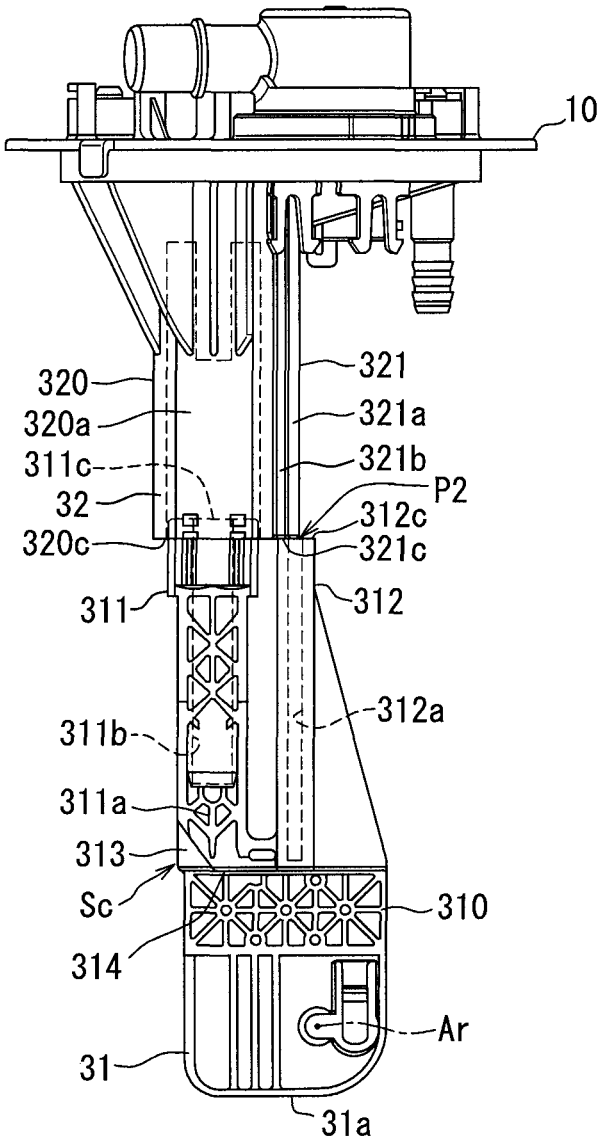
FIG. 18 is a front view showing a state of the fuel supply device that is different from the states of the fuel supply device respectively shown in FIGS. 1, 16 and 17 according to the first embodiment.

According to the first embodiment, at the second fitting initial position P2 where the lower tube segment 312 is slidably fitted to the upper column segment 321, the slide fitting of the lower column segment 311 relative to the upper tube segment 320 is further advanced in comparison to the first fitting initial position P1 where the lower column segment 311 is slidably fitted to the upper tube segment 320. Therefore, at the time of assembling the lower stay 31, in which the lower column segment 311 and the lower tube segment 312 are integrally formed, to the upper stay 32, in which the upper tube segment 320 and the upper column segment 321 are integrally formed, the timing of the slide fitting of the lower column segment 311 to the upper tube segment 320 and the timing of the slide fitting of the lower tube segment 312 to the upper column segment 321 are deviated from each other. Specifically, the lower column segment 311 is slidably fitted to the upper tube segment 320 from the first fitting initial position P1, as shown in FIG. 17, and thereafter the lower tube segment 312 begins the slide fitting relative to the upper column segment 321 from the second fitting initial position P2, as shown in FIG. 18. Although not depicted in FIGS. 17 and 18 for the sake of simplicity, the resilient member 33 is clamped between the upper tube segment 320 and the lower column segment 311 at the time of real assembly.

Here, in the first embodiment, the position of the tube-side lower end part 320*c* of the upper tube segment 320 coincides with the position of the column-side lower end part 321*c* of the upper column segment 321 in the top-to-bottom direction, and position of the column-side upper end part 311*c* of the lower column segment 311 is upwardly displaced from the position of the tube-side upper end part 312*c* of the lower tube segment 312. Therefore, the column-side upper end part 311*c* is slidably fitted to the tube-side lower end part 320*c* from the first fitting initial position P1 as shown in FIG. 17 certainly before the time of starting the slide fitting of the tube-side upper end part 312*c* relative to the column-side lower end part 321*c* from the second fitting initial position P2 shown in FIG. 18.

According to the first embodiment, the lower column segment 311 is positioned relative to the upper tube segment 320 at the first fitting initial position P1, and thereafter, the slide fitting of the lower column segment 311 relative to the upper tube segment 320 is advanced. Thereby, the relative displacement in the transverse direction between the lower stay 31 and the upper stay 32 can be limited. Thus, while the lower column segment 311 is guided by the upper tube segment 320, the lower tube segment 312 can be positioned relative to the upper column segment 321 at the second fitting initial position P2. As discussed above, not only the positioning at the first fitting initial position P1 can be easily achieved solely at the one side in the transverse direction, but also the positioning at the second fitting initial position P2 can be easily achieved at the opposite side, which is opposite from the one side in the transverse direction. As a result, it is possible to improve the work efficiency with respect to the assembling of the lower stay 31 to the upper stay 32, and thereby it is possible to improve the productivity.

Second Embodiment

A second embodiment of the present disclosure is a modification of the first embodiment.

Figure 21:
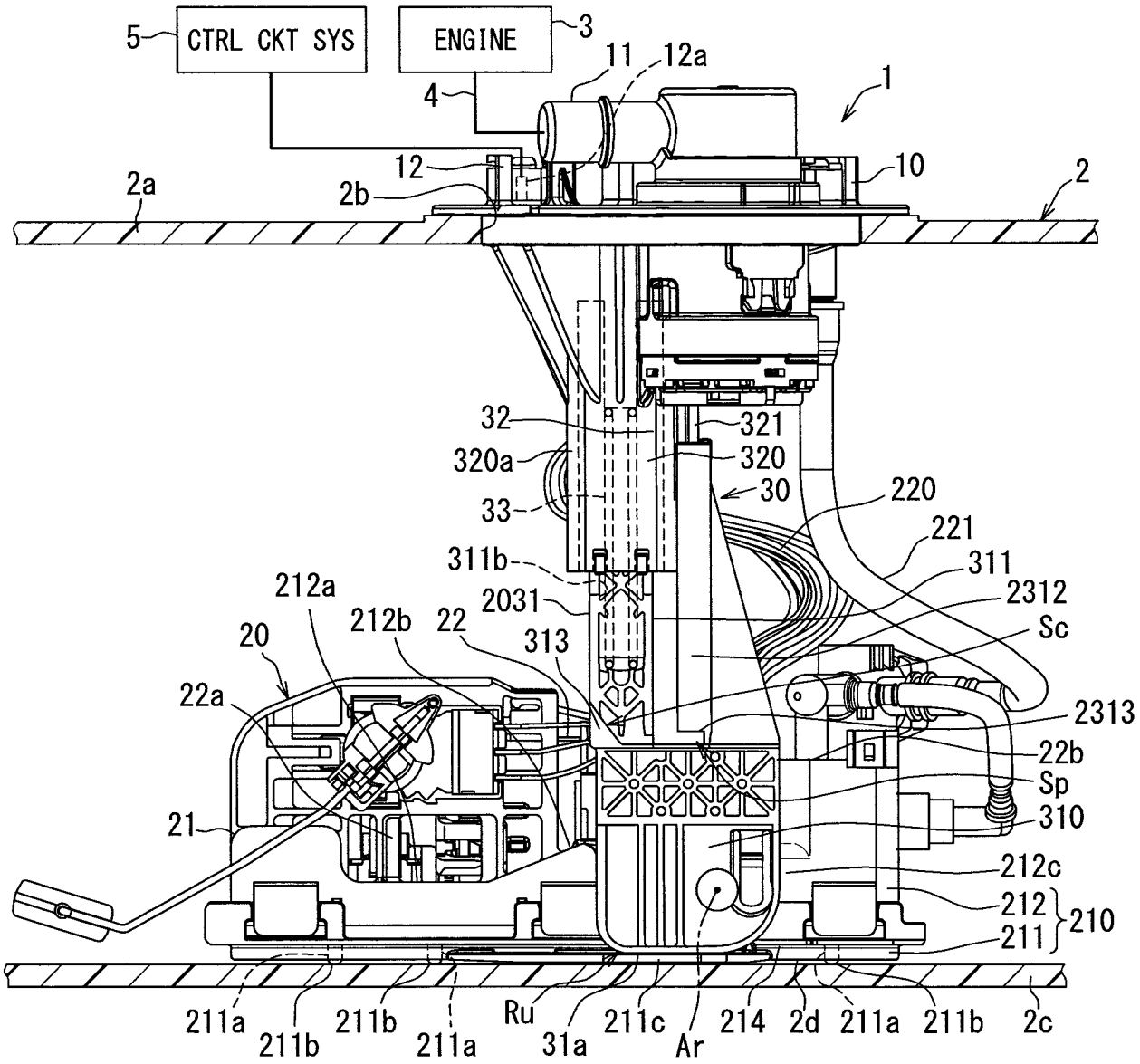
FIG. 21 is a front view of a fuel supply device according to a second embodiment of the present disclosure.
Figure 22:
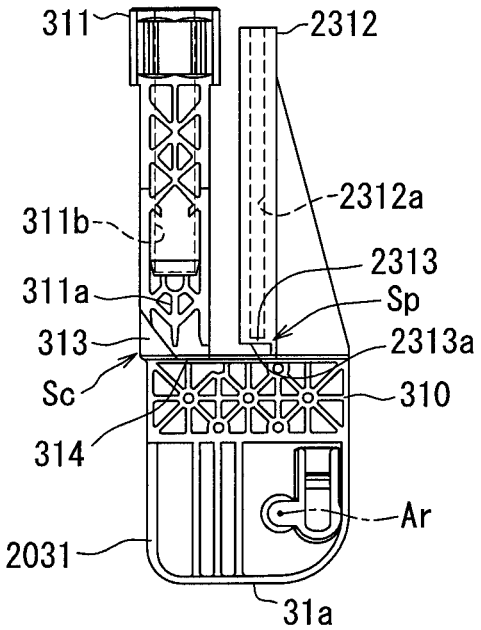
FIG. 22 is a front view showing a lower stay of the fuel supply device according to the second embodiment.

As shown in FIGS. 21 and 22, at a lower stay 2031 of the second embodiment, not only the stress concentrating portion 313 is formed at the specific location Sc of the lower column segment 311, which serves as the first lower segment, but another stress concentrating portion 2313 is also formed at a specific location Sp of a lower tube segment 2312, which serves as a second lower segment. Here, as shown in FIG. 22, the specific location Sp is set in a range that is from the boundary 314, which is between the rotatable plate segment 310 and the hollow tubular portion 2312*a* of the lower tube segment 2312, to a location that is upwardly spaced from the boundary 314 by a predetermined distance in the hollow tubular portion 2312*a* of the lower tube segment 2312. As shown in FIGS. 21 and 22, the specific location Sp is placed immediately above the lower end part 31*a* of the lower stay 2031 and is at the outside of the hollow tubular portion 320*a* of the upper tube segment 320.

Although not depicted in the drawings, even in the second embodiment, the column-side upper end part 311*c* of the lower stay 2031 is engaged to and is stopped by the recessed bottom surface 320*b* of the upper stay 32 when the slide fit length of the lower stay 2031 relative to the upper stay 32 is maximized. Furthermore, although not depicted in the drawings, even in the second embodiment, a position of the tube-side lower end part 320*c* of the upper tube segment 320 coincides with a position of the column-side lower end part 321*c* of the upper column segment 321 in the top-to-bottom direction, and a position of the column-side upper end part 311*c* of the lower column segment 311 is upwardly displaced from a position of the tube-side upper end part 312*c* of the lower tube segment 2312.

As shown in FIG. 22, the stress concentrating portion 2313, which is formed at the specific location Sp, is in a form of a recess recessed at a bottom of the hollow tubular portion 2312*a* of the lower tube segment 2312 in the lower stay 2031. Specifically, the stress concentrating portion 2313 includes a slit 2313*a* in the inside of the above-described recess while the slit 2313*a* extends in both the transverse direction, which is along the rotational axis Ar, and the transverse direction, which is perpendicular to the rotational axis Ar. At the stress concentrating portion 2313, due to the presence of the slit 2313*a*, a section modulus and a cross sectional area of a cross section, which is substantially parallel to the rotational axis Ar, are reduced in comparison to a section modulus and a cross sectional area of a cross section of another portion of the hollow tubular portion 2312*a* in a manner similar to that of the stress concentrating portion 313. Therefore, when a load, which is generated due to the expansion and contraction of the fuel tank 2, is applied to the lower stay 2031, a stress is concentrated at the stress concentrating portions 2313, 313, at each of which the section modulus and the cross-sectional area are reduced, in a manner similar to that of the first embodiment.

Figure 23:
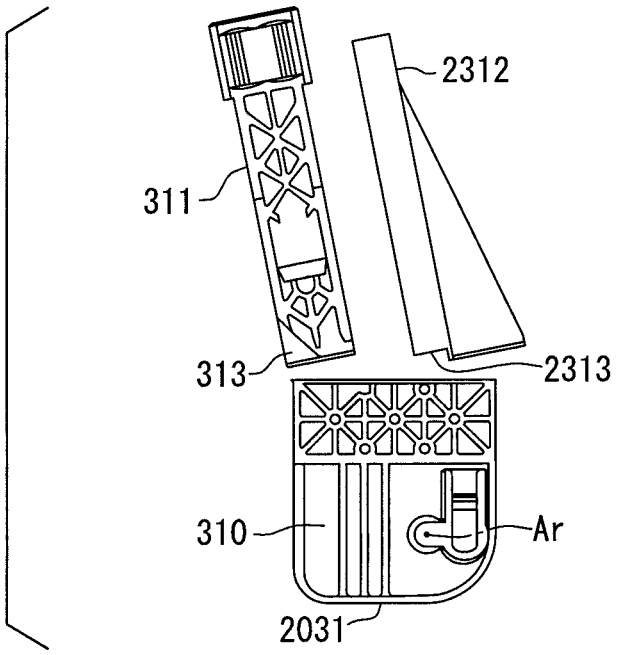
FIG. 23 is a schematic diagram for describing effects and advantages of the fuel supply device of the second embodiment.

As discussed above, according to the second embodiment, at the slide fit structure, in which the inside and outside relationship is reversed like in the first embodiment, the stress concentration portions 313, 2313 are respectively formed at the specific location Sc of the lower column segment 311 and the specific location Sp of the lower tube segment 2312. Thereby, when the excessive load is exerted along the coupling stay 30 in response to the excessive expansion and contraction of the fuel tank 2, the stress is concentrated at the stress concentrating portions 313, 2313, at each of which section modulus and the cross-sectional area are reduced. As a result, the breakage of the stress concentrating portions 313, 2313 may occur, as shown in FIG. 23, at the two locations of the lower stay 2031 that includes the lower column segment 311 and the lower tube segment 2312. Accordingly, the breakage of the lower stay 2031, which is prioritized over the cover body 10, can be easily induced, so that the damage limiting effect for limiting the damage of the cover body 10 can be increased. FIG. 23 exemplary shows a state where the stress concentrating portion 313 of the lower column segment 311 and the stress concentrating portion 2313 of the lower tube segment 2312 are broken to tilt about the rotational axis Ar and are thereby separated from the rotatable plate segment 310.

Furthermore, according to the second embodiment, in the structure, in which the lower stay 2031 is slidably fitted into the upper stay 32 from the lower side of the upper stay 32, the stress concentrating portions 313, 2313 are respectively formed at the specific locations Sc, Sp of the lower stay 2031, which are placed at the outside of the upper stay 32. Thereby, the breakage of the lower stay 2031 is generated at the outside of the upper stay 32. Here, in a case where the lower stay 2031 is broken in the inside of the upper stay 32 to leave all of broken fragments in the inside of the upper stay 32, the excessive load, which is proportional to a degree of the excessive expansion and contraction of the fuel tank 2, is transmitted through the broken fragments in the top-to-bottom direction and is continuously applied to the cover body 10. However, when the lower stay 2031 is designed to break at the outside of the upper stay 32, it is possible to limit the continuous application of the excessive load, which corresponds to the degree of the excessive expansion and contraction of the fuel tank 2, to the cover body 10. Thus, it is possible to enhance the damage limiting effect for limiting the damage of the cover body 10.

Furthermore, at the stress concentrating portion 2313, which is in the form of the recess at the lower stay 2031 of the second embodiment, the section modulus and the cross-sectional area at the specific location Sp can be adjusted by changing the recessing configuration of the recess. Accordingly, the damage limiting effect for limiting the damage of the cover body 10 can be enhanced by exercising the breaking function of the lower stay 2031, which is prioritized over the cover body 10, at the time of occurrence of the excess expansion and contraction of the fuel tank 2.

Third Embodiment

A third embodiment of the present disclosure is a modification of the first embodiment.

Figure 24:
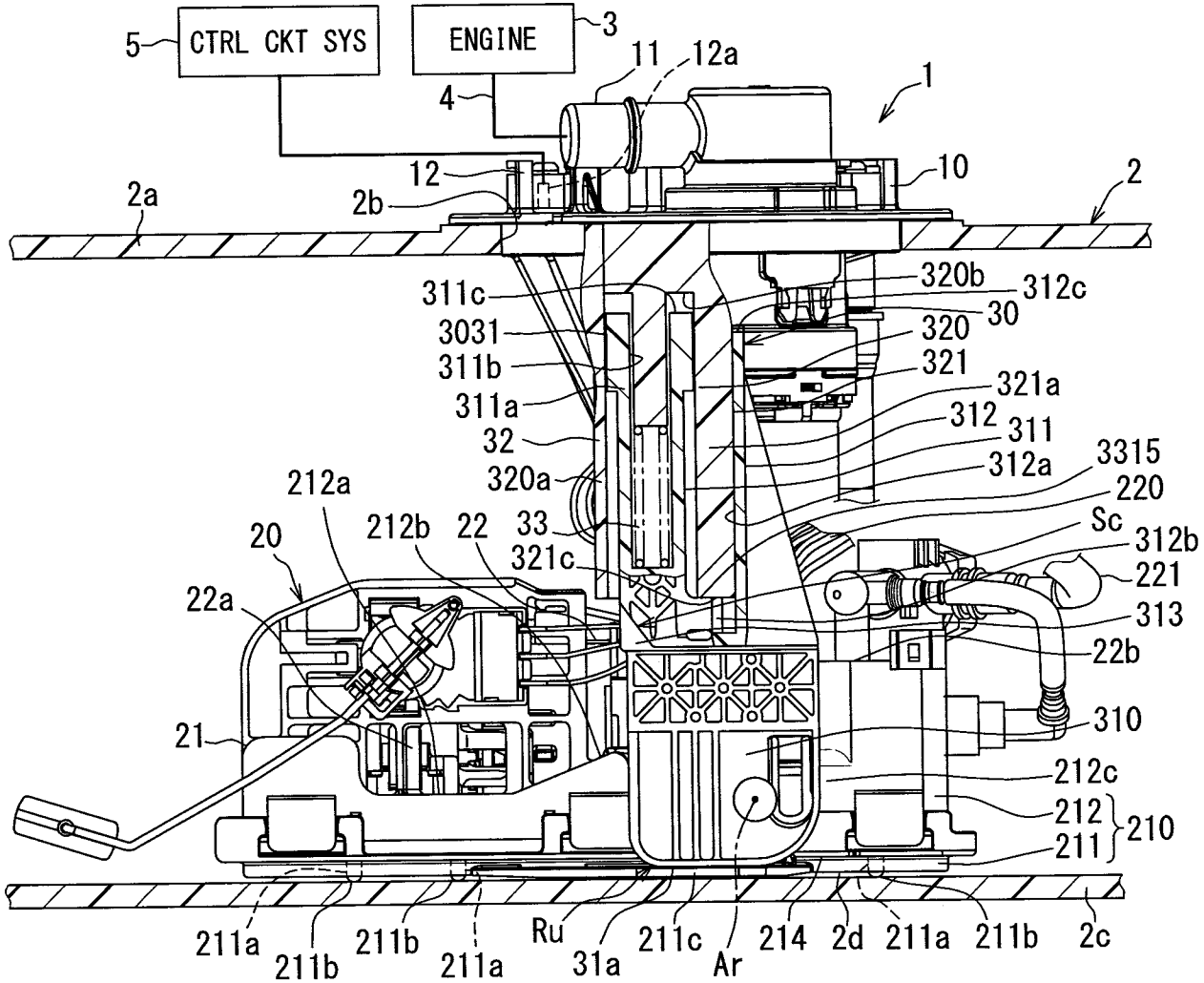
FIG. 24 is a partial cross-sectional view of a fuel supply device according to a third embodiment of the present disclosure.

As shown in FIG. 24, a lower stay 3031 of the third embodiment includes an engaging portion 3315 at a location between the lower column segment 311, which serves as the first lower segment, and the lower tube segment 312, which serves as the second lower segment. In the lower stay 3031, the engaging portion 3315 is downwardly spaced from the upper end part 311*c* of the lower column segment 311 and the upper end part 312*c* of the lower tube segment 312. With the above-described construction, the engaging portion 3315 is engaged to and is stopped by the column-side lower end part 321*c* of the upper column segment 321 of the upper stay 32 when the slide fit length of the lower stay 3031 relative to the upper stay 32 is maximized, as shown in FIG. 24. At this time, the recessed bottom surface 320*b* of the upper stay 32 and the column-side upper end part 311*c* of the lower stay 31 are spaced from each other in the top-to-bottom direction. Furthermore, although not depicted in the drawings, even in the third embodiment, a position of the tube-side lower end part 320*c* of the upper tube segment 320 coincides with a position of the column-side lower end part 321*c* of the upper column segment 321 in the top-to-bottom direction, and a position of the column-side upper end part 311*c* of the lower column segment 311 is upwardly displaced from a position of the tube-side upper end part 312*c* of the lower tube segment 312.

According to the third embodiment, the engaging portion 3315, which is placed on the lower side of the column-side upper end part 311*c* that is the uppermost part of the lower stay 3031, is engaged to and is stopped by the upper stay 32 when the slide fit length of the lower stay 31 relative to the upper stay 32 is maximized. Therefore, when the excessive load is exerted along the coupling stay 30 in response to the excessive expansion and contraction of the fuel tank 2, the slide fit length of the lower stay 3031 relative to the upper stay 32 is maximized. Thereby, a shock is generated in response to the engagement of the engaging portion 3315 to the upper stay 32. At this time, at the stress concentrating portion 313, which reduces the section modulus and the cross-sectional area to concentrate the stress around the stress concentrating portion 313, the breakage can be generated with the higher priority over the cover body 10 regardless of the generation of the shock. Furthermore, the location, at which the engaging portion 3315 located on the lower side of the upper end part 311*c* at the lower stay 3031 is engaged to and is stopped by the upper stay 32, is downwardly spaced from the cover body 10 as much as possible. Therefore, the shock, which is generated by the engagement of the engaging portion 3315 to the upper stay 32, is less likely to be transmitted to the cover body 10. Thereby, it is possible to enhance the damage limiting effect for limiting the damage of the cover body 10.

Fourth Embodiment

A fourth embodiment of the present disclosure is a modification of the first embodiment.

Figure 25:
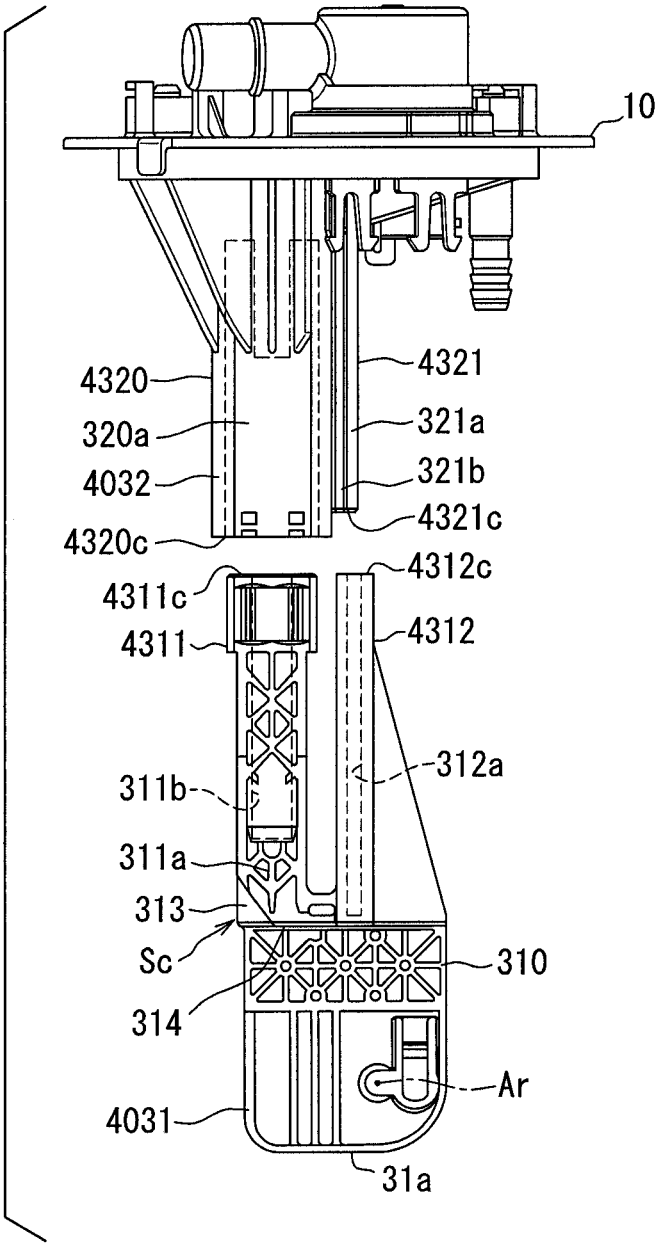
FIG. 25 is a front view of a fuel supply device according to a fourth embodiment of the present disclosure.

As shown in FIG. 25, in an upper stay 4032 of the fourth embodiment, a tube-side lower end part (serving as a first lower end part) 4320*c* of an upper tube segment (serving as a first upper segment) 4320 is downwardly spaced from a column-side lower end part (serving as a second lower end part) 4321*c* of an upper column segment (serving as a second upper segment) 4321 such that the tube-side lower end part 4320*c* is displaced stepwise relative to the column-side lower end part 4321*c*. Specifically, the tube-side lower end part 4320*c* is a lower end part of the upper stay 4032 that is placed at a lowermost position in the upper stay 4032. In contrast, at a lower stay 4031, a position of a column-side upper end part (serving as a first upper end part) 4311*c* of a lower column segment (serving as a first lower segment) 4311 coincides with a position of a tube-side upper end part (serving as a second upper end part) 4312*c* of a lower tube segment (serving as a second lower segment) 4312 in the top-to-bottom direction, so that the position of the column-side upper end part 4311*c* is not substantially displaced from the position of the tube-side upper end part 4312*c* in the top-to-bottom direction. Although not depicted in the drawings, even in the fourth embodiment, the column-side upper end part 4311*c* of the lower stay 4031 is engaged to and is stopped by the recessed bottom surface 320*b* of the upper stay 4032 when the slide fit length of the lower stay 4031 relative to the upper stay 4032 is maximized.

Figure 26:
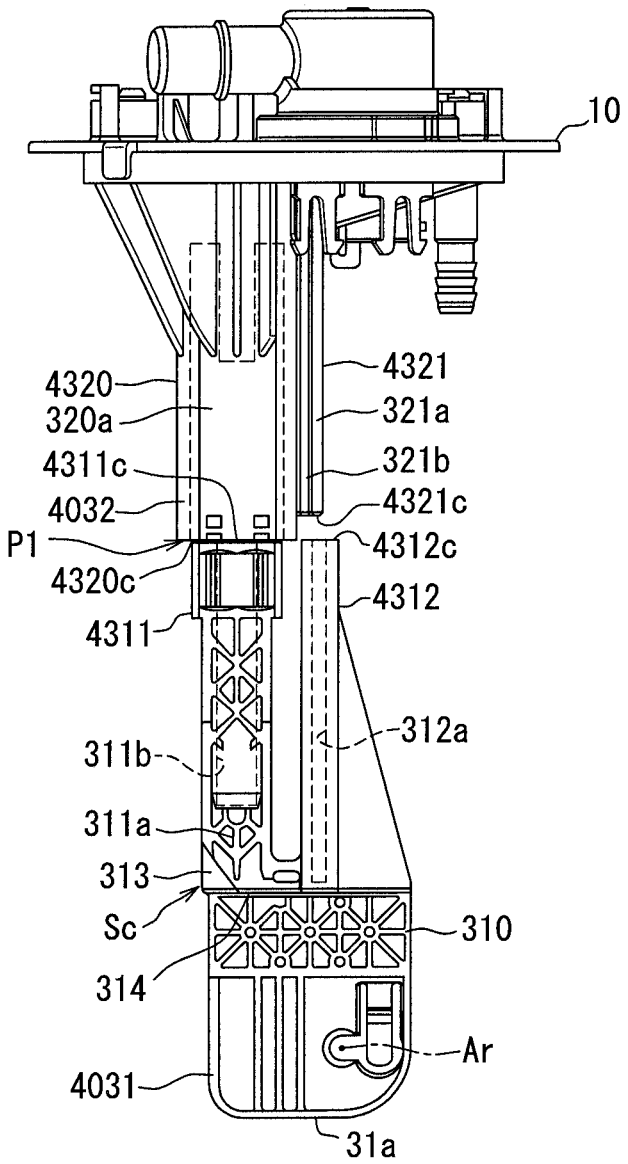
FIG. 26 is a front view showing a state of the fuel supply device that is different from the state of the fuel supply device shown in FIG. 25 according to the fourth embodiment.

Under the above-described end part positional relationship, the lower column segment 4311 is slidably fitted into the upper tube segment 4320 from a first fitting initial position P1 shown in FIG. 26 in the top-to-bottom direction. Specifically, the first fitting initial position P1 is an initial position, at which the column-side upper end part 4311*c* of the lower column segment 4311 begins the slide fitting relative to the tube-side lower end part 4320*c* of the upper tube segment 4320. In contrast, the lower tube segment 4312 is slidably fitted to the upper column segment 4321 in the top-to-bottom direction from a second fitting initial position P2 shown in FIG. 27. Specifically, the second fitting initial position P2 is an initial position, at which the tube-side upper end part 4312*c* of the lower tube segment 4312 begins the slide fitting relative to the column-side lower end part 4321*c* of the upper column segment 4321. Furthermore, the second fitting initial position P2 is a position, at which the slide fitting of the lower column segment 4311 relative to the upper tube segment 4320 is further advanced in comparison to the first fitting initial position P1 shown in FIG. 26.

Figure 27:
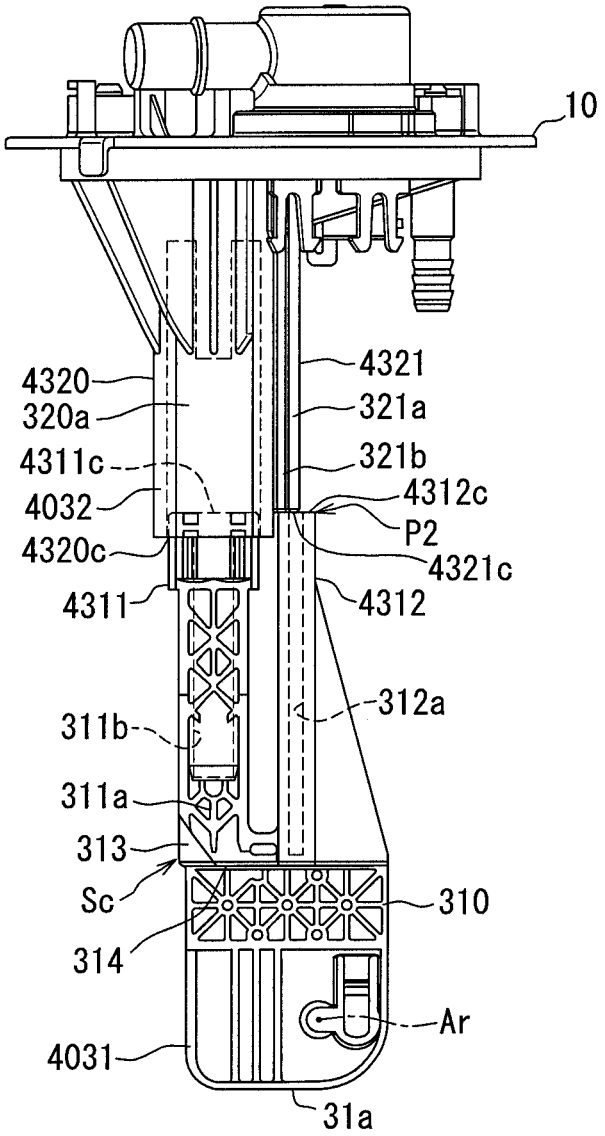
FIG. 27 is a front view showing a state of the fuel supply device that is different from the state of the fuel supply device shown in FIGS. 25 and 26 according to the fourth embodiment.

According to the fourth embodiment, at the second fitting initial position P2 where the lower tube segment 4312 is slidably fitted to the upper column segment 4321, the slide fitting of the lower column segment 4311 relative to the upper tube segment 4320 is further advanced in comparison to the first fitting initial position P1 where the lower column segment 4311 begins the slide fitting relative to the upper tube segment 4320. As a result, at the time of assembling the lower stay 4031 relative to the upper stay 4032, the timing of the slide fitting of the lower column segment 4311 relative to the upper tube segment 4320 is deviated from the timing of the slide fitting of the lower tube segment 4312 relative to the upper column segment 4321. Specifically, the lower column segment 4311 is slidably fitted to the upper tube segment 4320 from the first fitting initial position P1, as shown in FIG. 26, and thereafter the lower tube segment 4312 is slidably fitted to the upper column segment 4321 from the second fitting initial position P2, as shown in FIG. 27.

Here, in the fourth embodiment, a position of the tube-side lower end part 4320*c* of the upper tube segment 4320 is downwardly displaced from a position of the column-side lower end part 4321*c* of the upper column segment 4321, and a position of the column-side upper end part 4311*c* of the lower column segment 4311 coincides with a position of the tube-side upper end part 4312*c* of the lower tube segment 4312 in the top-to-bottom direction. Therefore, the column-side upper end part 4311*c* is slidably fitted to the tube-side lower end part 4320*c* from the first fitting initial position P1 as shown in FIG. 26 certainly before the time of starting the slide fitting of the tube-side upper end part 4312*c* relative to the column-side lower end part 4321*c* from the second fitting initial position P2 shown in FIG. 27.

According to the fourth embodiment, the principle, which is similar to the principle of the first embodiment, is established. Therefore, it is possible to improve the work efficiency with respect to the assembling of the lower stay 4031 to the upper stay 4032, and thereby it is possible to improve the productivity.

Fifth Embodiment

A fifth embodiment of the present disclosure is a modification of the first embodiment.

Figure 28:
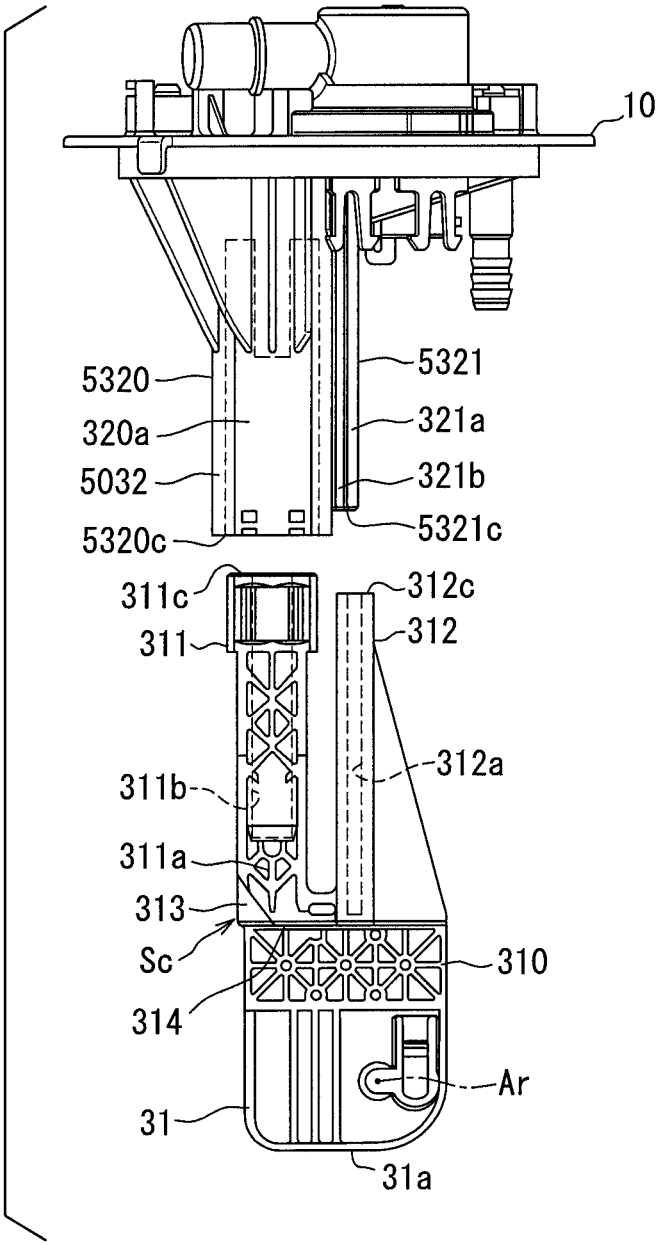
FIG. 28 is a front view of a fuel supply device according to a fifth embodiment of the present disclosure.

As shown in FIG. 28, in an upper stay 5032 of the fifth embodiment, a tube-side lower end part (serving as a first lower end part) 5320*c* of an upper tube segment (serving as a first upper segment) 5320 is downwardly spaced from a column-side lower end part (serving as a second lower end part) 5321*c* of an upper column segment (serving as a second upper segment) 5321 such that the tube-side lower end part 5320*c* is displaced stepwise relative to the column-side lower end part 5321*c*. Specifically, the tube-side lower end part 5320*c* is a lower end part of the upper stay 5032 that is placed at a lowermost position in the upper stay 5032. At the lower stay 31, similar to the first embodiment, the column-side upper end part (serving as the first upper end part) 311*c* of the lower column segment (serving as the first lower segment) 311 is upwardly spaced from the tube-side upper end part (serving as the second upper end part) 312*c* of the lower tube segment (serving as the second lower segment) 312 such that the column-side upper end part 311*c* is displaced stepwise relative to the tube-side upper end part 312*c*.

Figure 29:
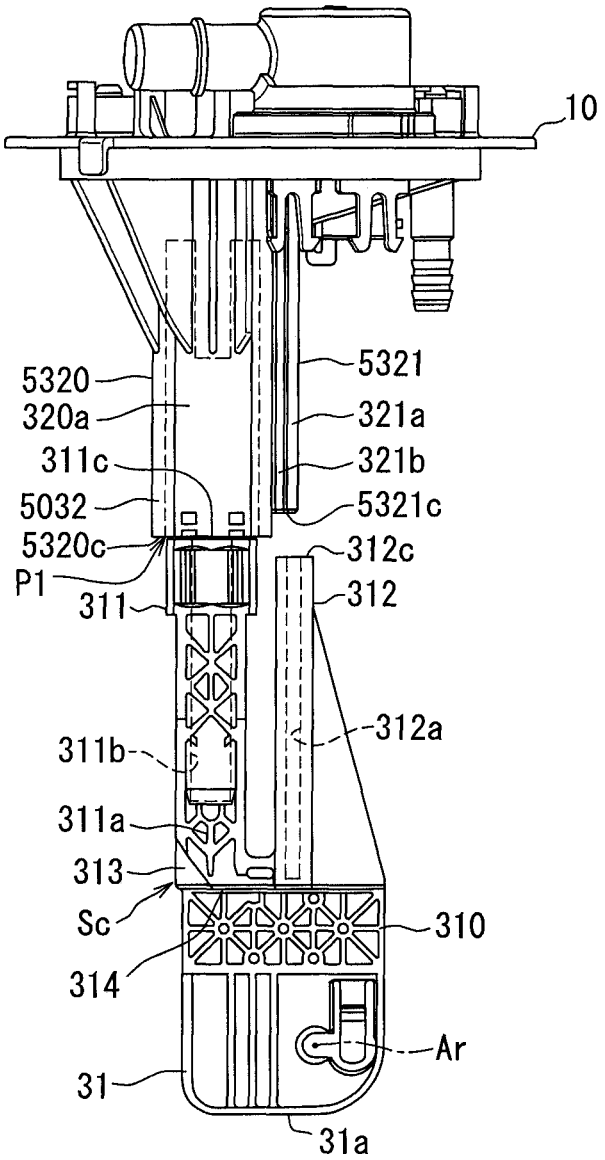
FIG. 29 is a front view showing a state of the fuel supply device that is different from the state of the fuel supply device shown in FIG. 28 according to the fifth embodiment.

Under the above-described end part positional relationship, the lower column segment 311 is slidably fitted to the upper tube segment 5320 from a first fitting initial position P1 shown in FIG. 29 in the top-to-bottom direction. Specifically, the first fitting initial position P1 is an initial position, at which the column-side upper end part 311*c* of the lower column segment 311 begins the slide fitting relative to the tube-side lower end part 5320*c* of the upper tube segment 5320. In contrast, the lower tube segment 312 is slidably fitted to the upper column segment 5321 in the top-to-bottom direction from a second fitting initial position P2 shown in FIG. 30. Specifically, the second fitting initial position P2 is an initial position, at which the tube-side upper end part 312*c* of the lower tube segment 312 begins the slide fitting relative to the column-side lower end part 5321*c* of the upper column segment 5321. Furthermore, the second fitting initial position P2 is a position, at which the slide fitting of the lower column segment 311 relative to the upper tube segment 5320 is further advanced in comparison to the first fitting initial position P1 shown in FIG. 29.

Figure 30:
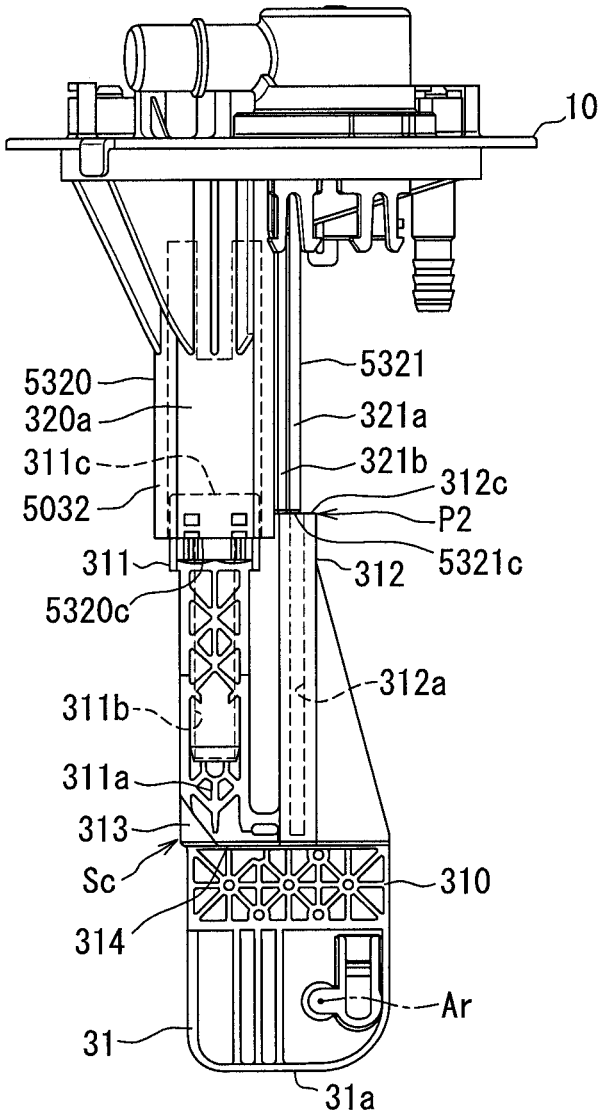
FIG. 30 is a front view showing a state of the fuel supply device that is different from the states of the fuel supply device respectively shown in FIGS. 28 and 29 according to the fifth embodiment.

According to the fifth embodiment, at the second fitting initial position P2 where the lower tube segment 312 is slidably fitted to the upper column segment 5321, the slide fitting of the lower column segment 311 relative to the upper tube segment 5320 is further advanced in comparison to the first fitting initial position P1 where the lower column segment 311 is slidably fitted to the upper tube segment 5320. As a result, at the time of assembling the lower stay 31 relative to the upper stay 5032, the timing of the slide fitting of the lower column segment 311 relative to the upper tube segment 5320 is deviated from the timing of the slide fitting of the lower tube segment 312 relative to the upper column segment 5321. Specifically, the lower column segment 311 is slidably fitted to the upper tube segment 5320 from the first fitting initial position P1, as shown in FIG. 29, and thereafter the lower tube segment 312 begins the slide fitting relative to the upper column segment 5321 from the second fitting initial position P2, as shown in FIG. 30.

Here, in the fifth embodiment, a position of the tube-side lower end part 5320*c* of the upper tube segment 5320 is downwardly displaced from a position of the column-side lower end part 5321*c* of the upper column segment 5321, and a position of the column-side upper end part 311*c* of the lower column segment 311 is upwardly displaced from a position of the tube-side upper end part 312*c* of the lower tube segment 312. Therefore, the column-side upper end part 311*c* is slidably fitted to the tube-side lower end part 5320*c* from the first fitting initial position P1 as shown in FIG. 29 certainly before the time of starting the slide fitting of the tube-side upper end part 312*c* relative to the column-side lower end part 5321*c* from the second fitting initial position P2 shown in FIG. 30.

According to the fifth embodiment, the principle, which is similar to the principle of the first embodiment, is established. Therefore, it is possible to improve the work efficiency with respect to the assembling of the lower stay 31 to the upper stay 5032, and thereby it is possible to improve the productivity.

Sixth Embodiment

A sixth embodiment of the present disclosure is a modification of the first embodiment.

Figure 31:
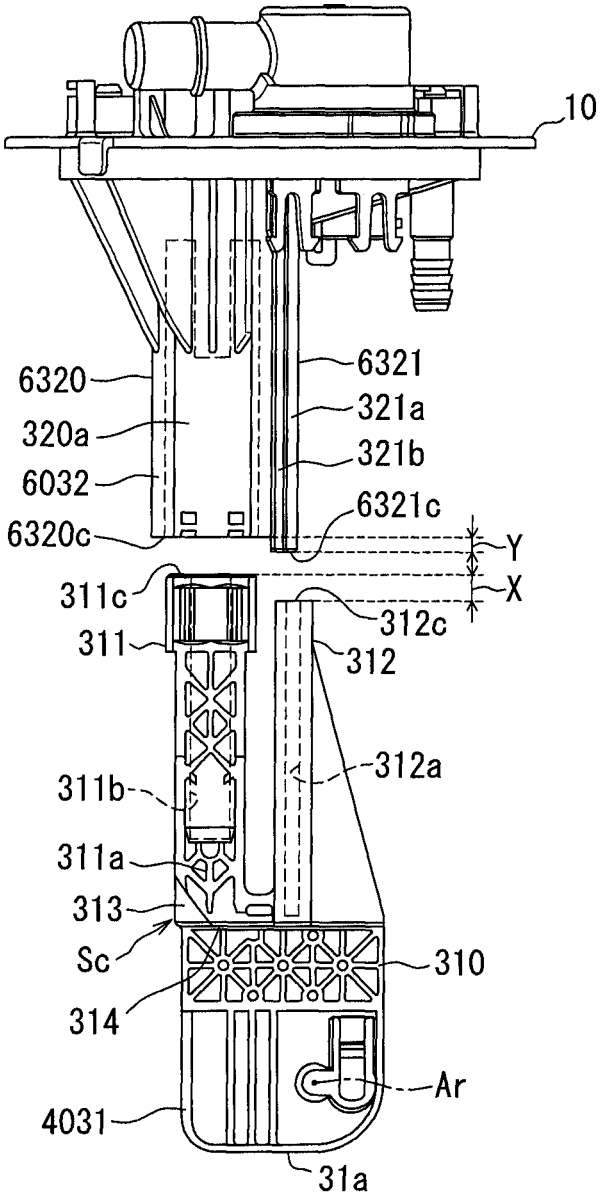
FIG. 31 is a front view of a fuel supply device according to a sixth embodiment of the present disclosure.

As shown in FIG. 31, in an upper stay 6032 of the sixth embodiment, a tube-side lower end part (serving as a first lower end part) 6320*c* of an upper tube segment (serving as a first upper segment) 6320 is upwardly spaced from a column-side lower end part (serving as a second lower end part) 6321*c* of an upper column segment (serving as a second upper segment) 6321 such that the tube-side lower end part 6320*c* is displaced stepwise relative to the column-side lower end part 6321*c*. Specifically, a lower end part of the upper stay 6032, which is placed at a lowermost position in the upper stay 6032, forms the column-side lower end part 6321*c*. At the lower stay 31, similar to the first embodiment, the column-side upper end part (serving as the first upper end part) 311*c* of the lower column segment (serving as the first lower segment) 311 is upwardly spaced from the tube-side upper end part (serving as the second upper end part) 312*c* of the lower tube segment (serving as the second lower segment) 312 such that the column-side upper end part 311*c* is displaced stepwise relative to the tube-side upper end part 312*c*. Here, the amount X of displacement of the column-side upper end part 311*c* relative to the tube-side upper end part 312*c* is larger than the amount Y of displacement of the tube-side lower end part 6320*c* relative to the column-side lower end part 6321*c*.

Figure 32:
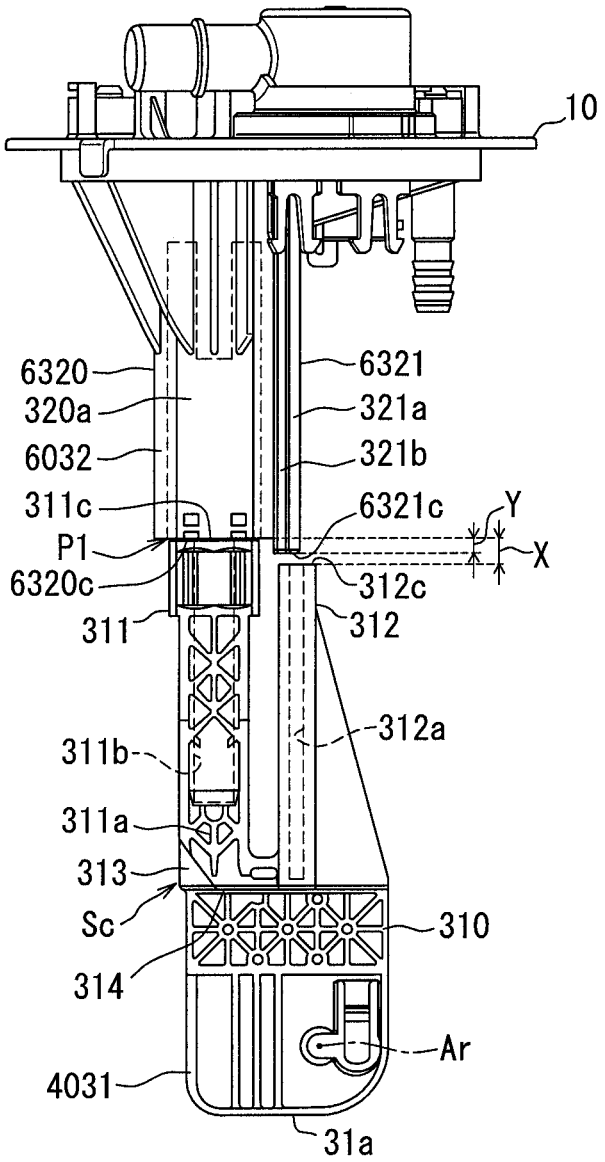
FIG. 32 is a front view showing a state of the fuel supply device that is different from the state of the fuel supply device shown in FIG. 31 according to the sixth embodiment.

Under the above-described end part positional relationship, the lower column segment 311 is slidably fitted to the upper tube segment 6320 from a first fitting initial position P1 shown in FIG. 32 in the top-to-bottom direction. Specifically, the first fitting initial position P1 is an initial position, at which the column-side upper end part 311*c* of the lower column segment 311 begins the slide fitting relative to the tube-side lower end part 6320*c* of the upper tube segment 6320. In contrast, the lower tube segment 312 is slidably fitted to the upper column segment 6321 in the top-to-bottom direction from a second fitting initial position P2 shown in FIG. 33. Specifically, the second fitting initial position P2 is an initial position, at which the tube-side upper end part 312*c* of the lower tube segment 312 begins the slide fitting relative to the column-side lower end part 6321*c* of the upper column segment 6321. Furthermore, the second fitting initial position P2 is a position, at which the slide fitting of the lower column segment 311 relative to the upper tube segment 6320 is further advanced in comparison to the first fitting initial position P1 shown in FIG. 32.

Figure 33:
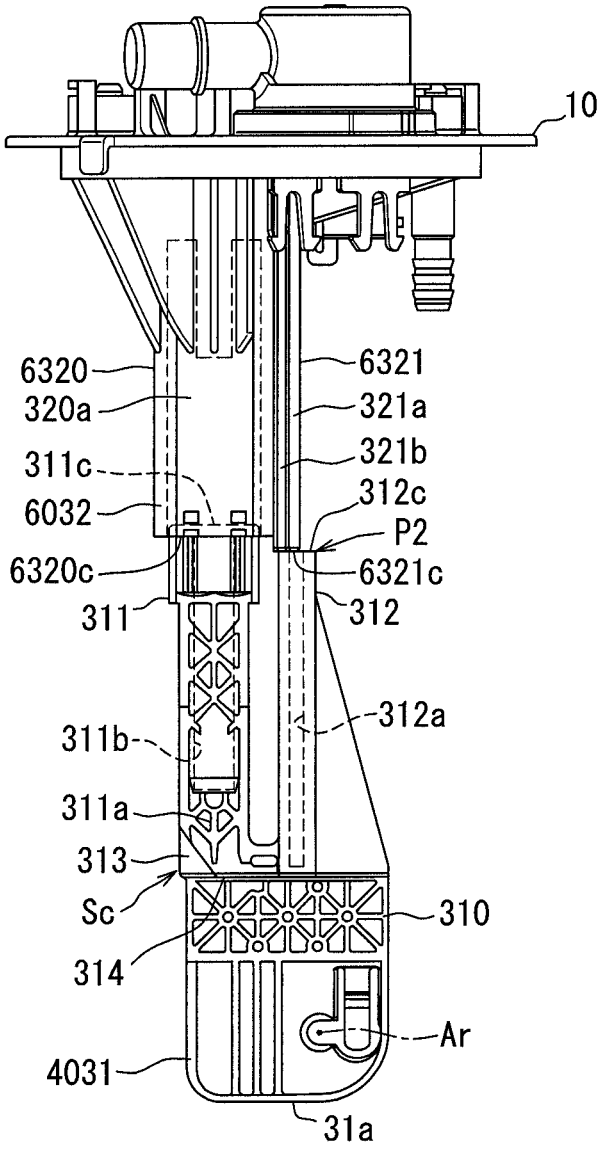
FIG. 33 is a front view showing a state of the fuel supply device that is different from the states of the fuel supply device respectively shown in FIGS. 31 and 32 according to the sixth embodiment.

According to the sixth embodiment, at the second fitting initial position P2 where the lower tube segment 312 is slidably fitted to the upper column segment 6321, the slide fitting of the lower column segment 311 relative to the upper tube segment 6320 is further advanced in comparison to the first fitting initial position P1 where the lower column segment 311 begins the slide fitting relative to the upper tube segment 6320. As a result, at the time of assembling the lower stay 31 relative to the upper stay 6032, the timing of the slide fitting of the lower column segment 311 relative to the upper tube segment 6320 is deviated from the timing of the slide fitting of the lower tube segment 312 relative to the upper column segment 6321. Specifically, the lower column segment 311 is slidably fitted to the upper tube segment 6320 from the first fitting initial position P1, as shown in FIG. 32, and thereafter the lower tube segment 312 begins the slide fitting relative to the upper column segment 6321 from the second fitting initial position P2, as shown in FIG. 33.

Here, in the sixth embodiment, a position of the tube-side lower end part 6320*c* of the upper tube segment 6320 is upwardly displaced from a position of the column-side lower end part 6321*c* of the upper column segment 6321, and a position of the column-side upper end part 311*c* of the lower column segment 311 is upwardly displaced from a position of the tube-side upper end part 312*c* of the lower tube segment 312. However, in the sixth embodiment, the amount X of displacement of the column-side upper end part 311*c* relative to the tube-side upper end part 312*c* is larger than the amount Y of displacement of the tube-side lower end part 6320*c* relative to the column-side lower end part 6321*c*. Therefore, the column-side upper end part 311*c* is slidably fitted to the tube-side lower end part 6320*c* from the first fitting initial position P1 as shown in FIG. 32 certainly before the time of starting the slide fitting of the tube-side upper end part 312*c* relative to the column-side lower end part 6321*c* from the second fitting initial position P2 shown in FIG. 33.

According to the sixth embodiment, the principle, which is similar to the principle of the first embodiment, is established. Therefore, it is possible to improve the work efficiency with respect to the assembling of the lower stay 31 to the upper stay 6032, and thereby it is possible to improve the productivity.

Seventh Embodiment

A seventh embodiment of the present disclosure is a modification of the fourth embodiment.

Figure 34:
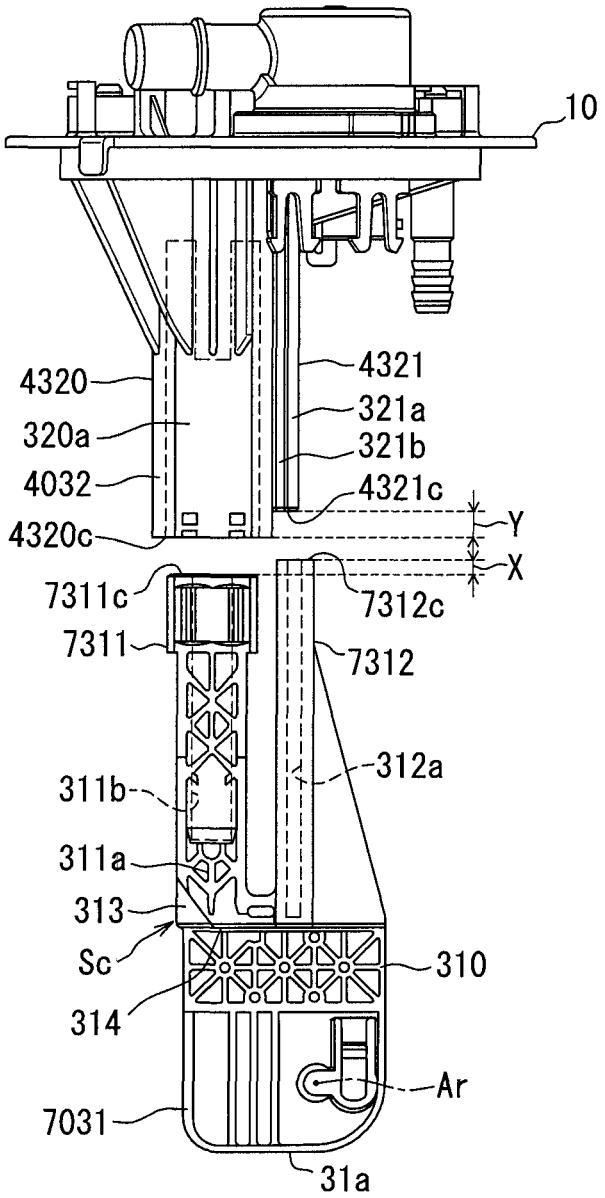
FIG. 34 is a front view of the fuel supply device according to the sixth embodiment.

At a lower stay 7031 of the seventh embodiment, as shown in FIG. 34, a column-side upper end part (serving as a first upper end part) 7311*c* of a lower column segment (serving as a first lower segment) 7311 is downwardly spaced from a tube-side upper end part (serving as a second upper end part) 7312*c* of a lower tube segment (serving as a second lower segment) 7312 such that the column-side upper end part 7311*c* is displaced stepwise relative to the tube-side upper end part 7312*c*. Specifically, an upper end part of the lower stay 7031, which is placed at an uppermost location at the lower stay 7031, forms the tube-side upper end part 7312*c*. Similar to the fourth embodiment, in the upper stay 4032, a tube-side lower end part (serving as a first lower end part) 4320*c* of an upper tube segment (serving as a first upper segment) 4320 is downwardly spaced from a column-side lower end part (serving as a second lower end part) 4321*c* of an upper column segment (serving as a second upper segment) 4321 such that the tube-side lower end part 4320*c* is displaced stepwise relative to the column-side lower end part 4321*c*. Here, the amount Y of displacement of the tube-side lower end part 4320*c* relative to the column-side lower end part 4321*c* is larger than the amount X of displacement of the column-side upper end part 7311*c* relative to the tube-side upper end part 7312*c*. Although not depicted in the drawings, even in the seventh embodiment, the column-side upper end part 7311*c* of the lower stay 7031 is engaged to and is stopped by the recessed bottom surface 320*b* of the upper stay 4032 when the slide fit length of the lower stay 7031 relative to the upper stay 4032 is maximized.

Figure 35:
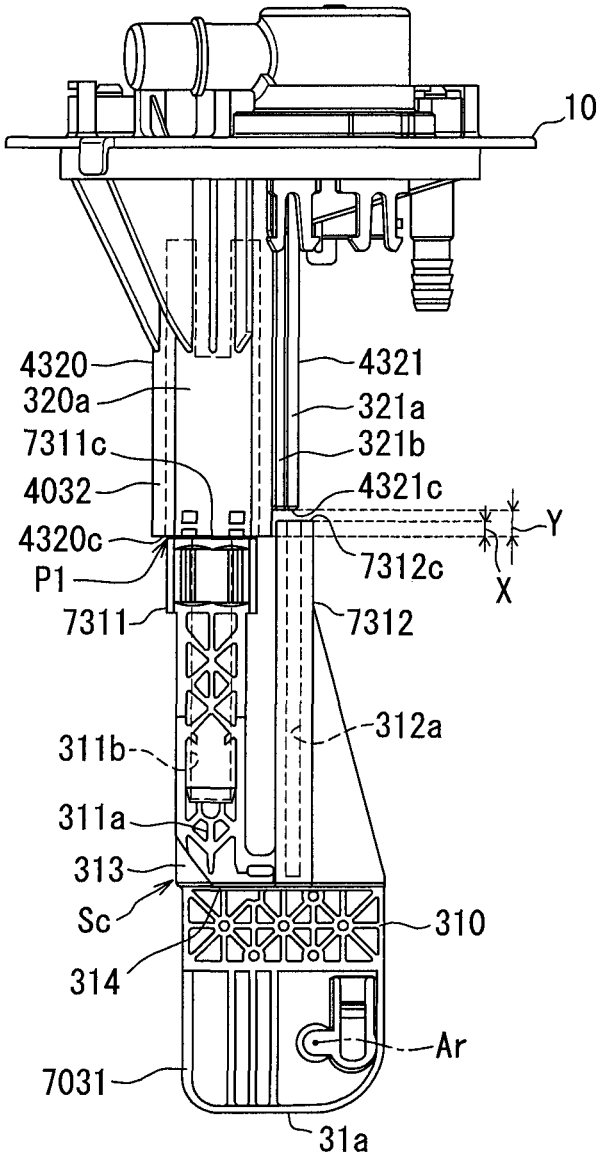
FIG. 35 is a front view showing a state of the fuel supply device that is different from the state of the fuel supply device shown in FIG. 34 according to the sixth embodiment.

Under the above-described end part positional relationship, the lower column segment 7311 is slidably fitted to the upper tube segment 4320 from a first fitting initial position P1 shown in FIG. 35 in the top-to-bottom direction. Specifically, the first fitting initial position P1 is an initial position, at which the column-side upper end part 7311*c* of the lower column segment 7311 begins the slide fitting relative to the tube-side lower end part 4320*c* of the upper tube segment 4320. In contrast, the lower tube segment 7312 is slidably fitted to the upper column segment 4321 in the top-to-bottom direction from a second fitting initial position P2 shown in FIG. 36. Specifically, the second fitting initial position P2 is an initial position, at which the tube-side upper end part 7312*c* of the lower tube segment 7312 begins the slide fitting relative to the column-side lower end part 4321*c* of the upper column segment 4321. Furthermore, the second fitting initial position P2 is a position, at which the slide fitting of the lower column segment 7311 relative to the upper tube segment 4320 is further advanced in comparison to the first fitting initial position P1 shown in FIG. 35.

Figure 36:
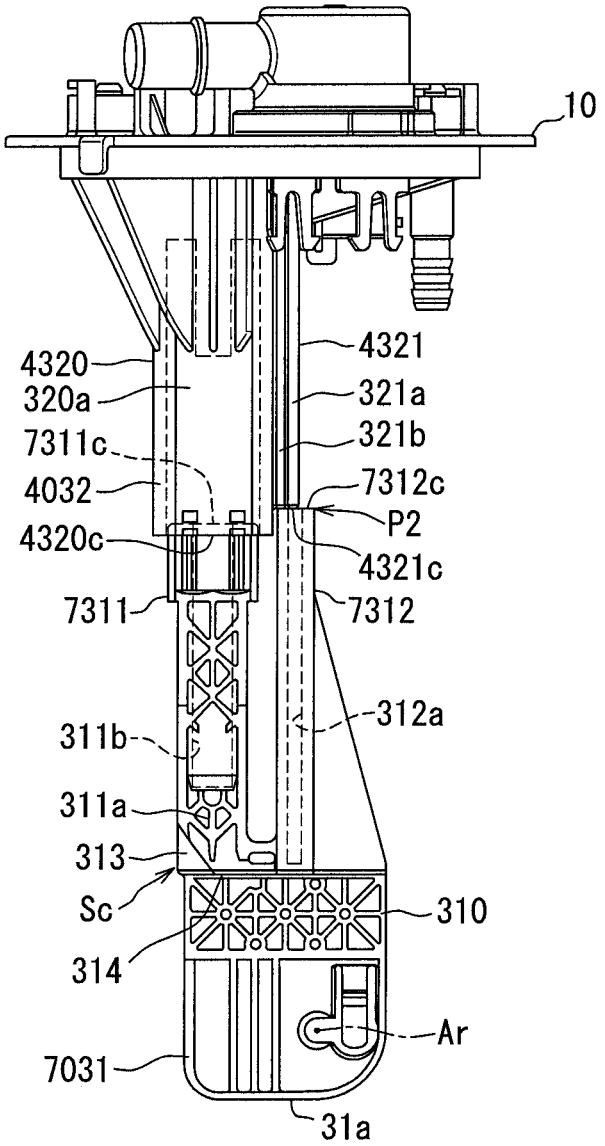
FIG. 36 is a front view showing a state of the fuel supply device that is different from the states of the fuel supply device respectively shown in FIGS. 34 and 35 according to the sixth embodiment.

According to the seventh embodiment, at the second fitting initial position P2 where the lower tube segment 7312 is slidably fitted to the upper column segment 4321, the slide fitting of the lower column segment 7311 relative to the upper tube segment 4320 is further advanced in comparison to the first fitting initial position P1 where the lower column segment 7311 begins the slide fitting relative to the upper tube segment 4320. As a result, at the time of assembling the lower stay 7031 relative to the upper stay 4032, the timing of the slide fitting of the lower column segment 7311 relative to the upper tube segment 4320 is deviated from the timing of the slide fitting of the lower tube segment 7312 relative to the upper column segment 4321. Specifically, the lower column segment 7311 is slidably fitted to the upper tube segment 4320 from the first fitting initial position P1, as shown in FIG. 35, and thereafter the lower tube segment 7312 begins the slide fitting relative to the upper column segment 4321 from the second fitting initial position P2, as shown in FIG. 36.

Here, in the seventh embodiment, a position of the tube-side lower end part 4320*c* of the upper tube segment 4320 is downwardly displaced from a position of the column-side lower end part 4321*c* of the upper column segment 4321, and a position of the column-side upper end part 7311*c* of the lower column segment 7311 is downwardly displaced from a position of the tube-side upper end part 7312*c* of the lower tube segment 7312. However, in the seventh embodiment, the amount Y of displacement of the tube-side lower end part 4320*c* relative to the column-side lower end part 4321*c* is larger than the amount X of displacement of the column-side upper end part 7311*c* relative to the tube-side upper end part 7312*c*. Therefore, the column-side upper end part 7311*c* is slidably fitted to the tube-side lower end part 4320*c* from the first fitting initial position P1 as shown in FIG. 35 certainly before the time of starting the slide fitting of the tube-side upper end part 7312*c* relative to the column-side lower end part 4321*c* from the second fitting initial position P2 as shown in FIG. 36.

According to the seventh embodiment, the principle, which is similar to the principle of the first embodiment, is established. Therefore, it is possible to improve the work efficiency with respect to the assembling of the lower stay 7031 to the upper stay 4032, and thereby it is possible to improve the productivity.

Other Embodiments

Although the embodiments of the present disclosure have been described, the present disclosure should not be limited to the above embodiments and may be applied to various other embodiments and combinations thereof without departing form the scope of the present disclosure.

Figure 37:
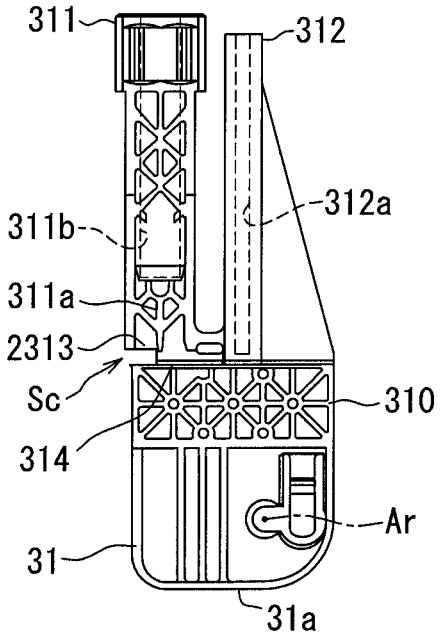
FIG. 37 is a front view showing a modification of FIG. 6.
Figure 38:
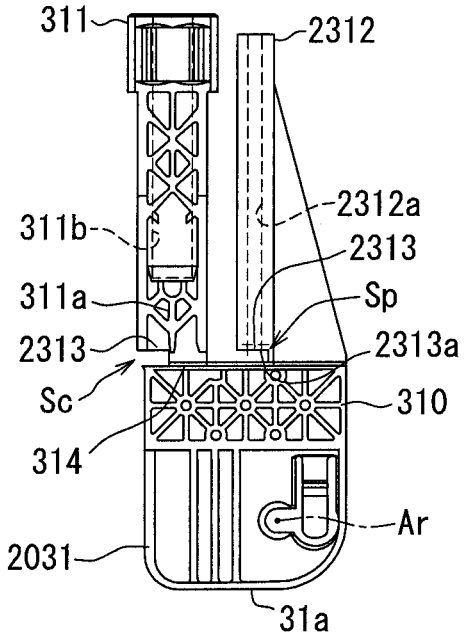
FIG. 38 is a front view showing a modification of FIG. 22.

Specifically, as a first modification with respect to the first and second embodiments, as shown in FIGS. 37 and 38, the stress concentrating portion 2313, which is according to the second embodiment, may be provided to the specific location Sc of the lower column segment 311. Here, in the first modification with respect to the second embodiment, as shown in FIG. 38, the stress concentrating portion 2313 is formed not only at the specific location Sp of the lower tube segment 2312 but also the specific location Sc of the lower column segment 311. FIG. 37 indicates the first modification of the first embodiment, and FIG. 38 indicates the first modification of the second embodiment.

Figure 39:
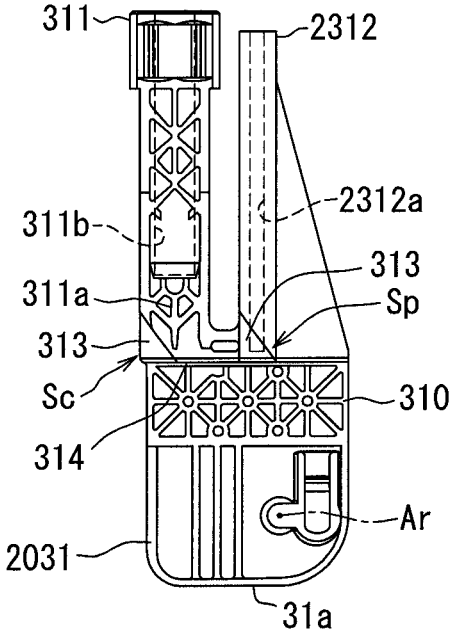
FIG. 39 is a front view showing a modification of FIG. 22.
Figure 40:
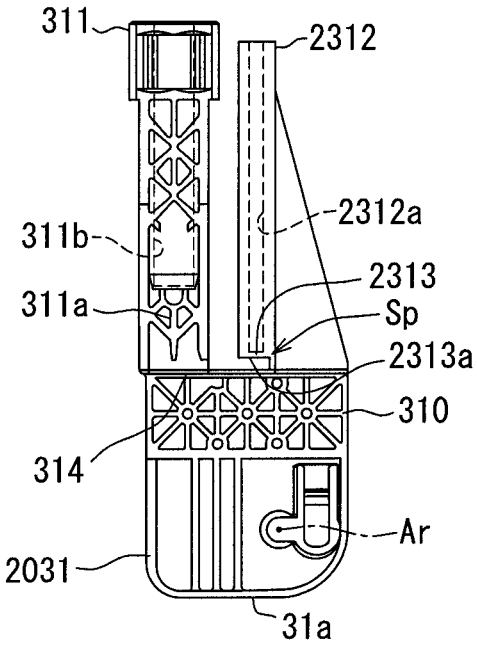
FIG. 40 is a front view showing a modification of FIG. 22.

As a second modification with respect to the second embodiment, as shown in FIG. 39, the stress concentrating portion 313, which is according to the first embodiment, may be provided not only to the specific location Sc of the lower column segment 311 but also the specific location Sp of the lower tube segment 2312. As a third modification with respect to the second embodiment, as shown in FIG. 40, the stress concentrating portion 2313 may be formed only at the specific location Sp of the lower tube segment 2312 without forming the stress concentrating portion 313 at the specific location Sc of the lower column segment 311.

Figure 41:
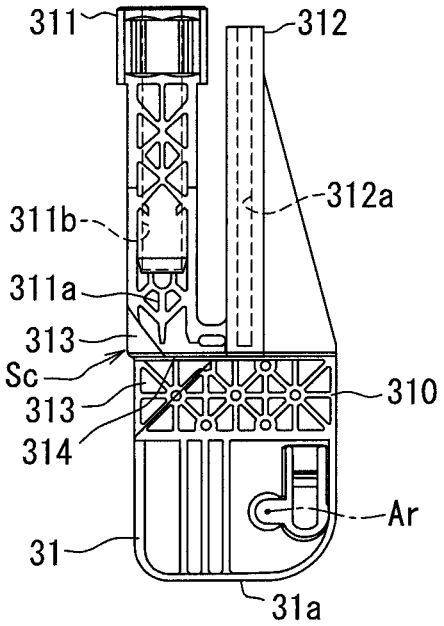
FIG. 41 is a front view showing a modification of FIG. 6.
Figure 42:
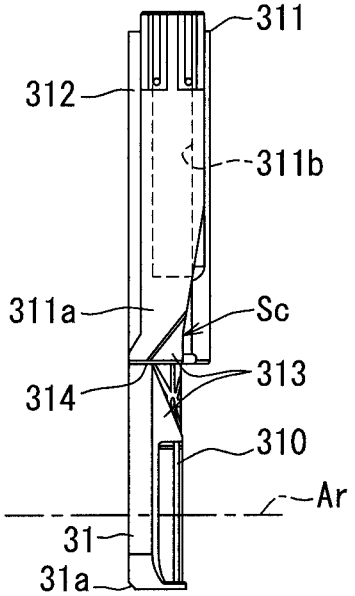
FIG. 42 is a front view showing a modification of FIG. 7.
Figure 43:
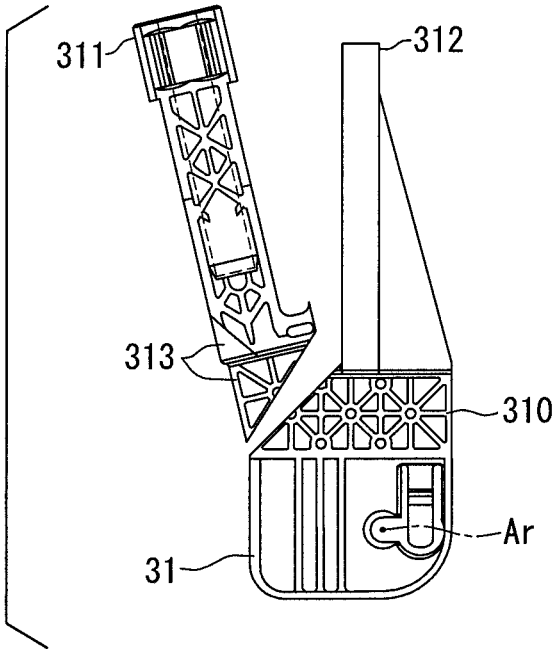
FIG. 43 is a front view showing a modification of FIG. 19.

As a fourth modification with respect to the first embodiment, as shown in FIGS. 41 to 43, the stress concentrating portion 313, which is according to the first embodiment, may be formed at a specific location of the rotatable plate segment 310 in addition to or alternative to the specific location Sc of the lower column segment 311. FIGS. 41 to 43 show the fourth modification, in which the stress concentrating portion 313 is formed at the specific location of the rotatable plate segment 310 in addition to the specific location Sc of the lower column segment 311. As a fifth modification with respect to the second embodiment, although not depicted in the drawings, the stress concentrating portion 2313, which is according to the second embodiment, may be formed at a specific location of the rotatable plate segment 310 in addition to or alternative to the specific location Sp of the lower tube segment 2312.

As a sixth modification with respect to the first and second embodiments, the specific location Sc may be displaced from the location immediate above the lower end part 31*a* at the lower stay 31, 2031. As a seventh modification with respect to the second embodiment, the specific location Sp may be displaced from the location immediately above the lower end part 31*a* at the lower stay 2031.

As an eighth modification with respect to the first and second embodiments, the stress concentrating portion 313 may be formed at the specific location Sc of the lower stay 31, 2031, which is placed in an inside of the upper stay 32. As a ninth modification with respect to the first and second embodiments, the upper column segment 321, which does not have the rib portion 321*b*, may be spaced from the upper tube segment 320 in the transverse direction. As a tenth modification with respect to the first embodiment, the set of the upper column segment 321 and the lower tube segment 312 may be eliminated.

As an eleventh modification with respect to the first and second embodiments, the upper stay 32 may downwardly project from an element, which is integral with the cover body 10 or is fixed to the cover body 10 to implement the upper stay 32, which extends on the lower side of the cover body 10. As a twelfth modification with respect to the first and second embodiments, the resilient member 33 may be placed at a location, which is other than the location between the upper tube segment 320 and the lower column segment 311, according to the disclosed device of the patent literature 1 discussed above.

As a thirteenth modification with respect to the first and second embodiments, the lower column segment 311, which serves as the first lower segment, may be changed to a lower tube segment by forming a hollow tubular portion therein, and the lower tube segment 312, 2312, which serves as the second lower segment, may be changed to a lower column segment by forming a solid column portion therein. Here, in the thirteenth modification, the upper tube segment 320, which serves as the first upper segment, is changed to an upper column segment by forming a solid column portion therein, and the upper column segment 321, which serves as the second upper segment, is changed to the upper tube segment by forming a hollow tubular portion therein. In this way, in the thirteenth modification, the upper column segment, which is changed from the upper tube segment 320, is slidably fitted to the lower tube segment, which is changed from the lower column segment 311, in the top-to-bottom direction. Furthermore, in the thirteenth modification, the upper tube segment, which is changed from the upper column segment 321, is slidably fitted to the lower column segment, which is changed from the lower tube segment 312, 2312, in the top-to-bottom direction.

Figure 44:
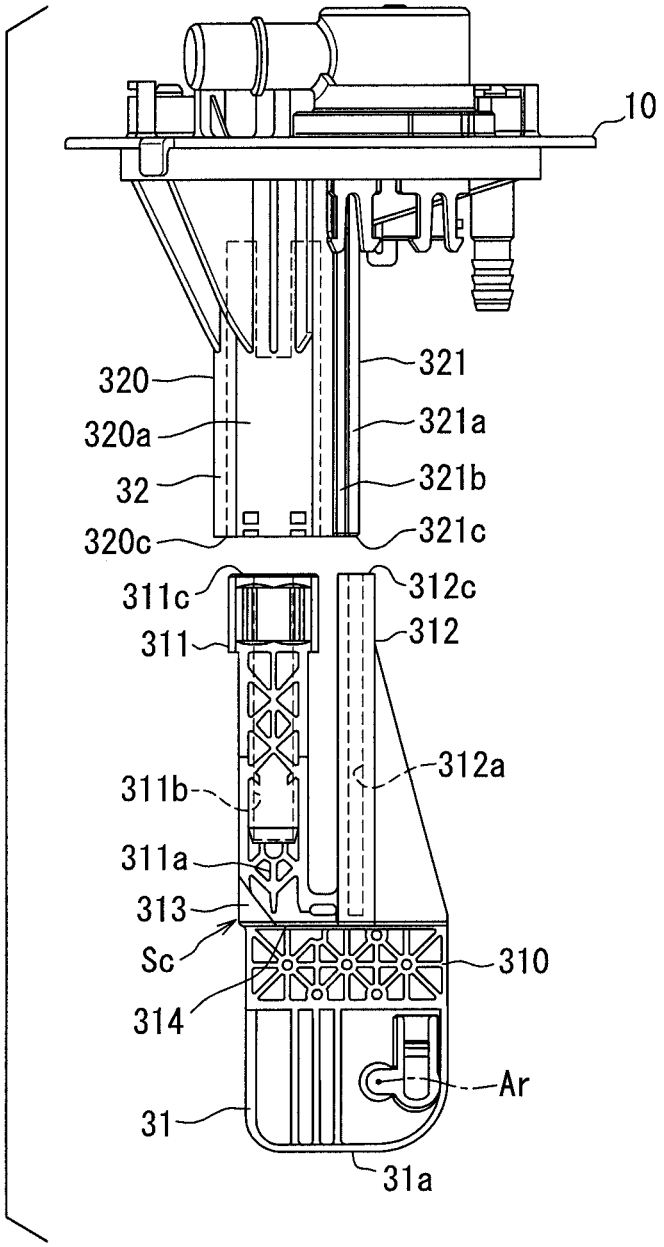
FIG. 44 is a front view showing a modification of FIG. 16.

As a fourteenth modification with respect to the first and second embodiments, as shown in FIG. 44, the position of the column-side upper end part (serving as the first upper end part) 311*c* of the lower column segment (serving as the first lower segment) 311 may be set to coincide with the position of the tube-side upper end part (serving as the second upper end part) 312*c* of the lower tube segment (serving as the second lower segment) 312 in the top-to-bottom direction, so that the position of the column-side upper end part 311*c* is not substantially displaced from the position of the tube-side upper end part 312*c* in the top-to-bottom direction.

Besides the above modifications, the second embodiment and the first to ninth and eleventh to thirteenth modifications may be appropriately used in the third to seventh embodiments. Furthermore, the tenth and fourteenth modifications may be appropriately used in the third embodiment. Furthermore, the third embodiment may be appropriately used in the fourth to seventh embodiments.

The invention claimed is:

1. A fuel supply device configured to supply fuel from an inside of a fuel tank to an internal combustion engine, comprising:

a cover body that is configured to be installed to an upper wall of the fuel tank;

a pump unit that is configured to be placed on a bottom wall of the fuel tank and is configured to discharge the fuel from the inside of the fuel tank toward the internal combustion engine; and a coupling stay that couples between the cover body and the pump unit, wherein:

the coupling stay includes:

an upper stay that extends on a lower side of the cover body; and a lower stay that is installed to the pump unit and is slidably fitted to the upper stay in a top-to-bottom direction; and a stress concentrating portion, which reduces a section modulus to concentrate a stress around the stress concentrating portion, is formed at a specific location of the lower stay, the specific location being located immediately above a lower end part of the lower stay;

the lower stay is slidably fitted into the upper stay from a lower side of the upper stay;

the stress concentrating portion is formed at the specific location of the lower stay, which is placed at an outside of the upper stay;

the upper stay includes:

an upper tube segment that forms a hollow tubular portion; and an upper column segment that forms a solid column portion;

the lower stay includes:

a lower column segment that forms a solid column portion; and a lower tube segment that forms a hollow tubular portion;

the lower column segment is slidably fitted into the hollow tubular portion of the upper tube segment from a lower side of the hollow tubular portion of the upper tube segment;

the upper column segment is slidably fitted into the hollow tubular portion of the lower tube segment from an upper side of the hollow tubular portion of the lower tube segment; and the stress concentrating portion is formed at the specific location of the lower stay located in at least one of the lower column segment and the lower tube segment.

2. A fuel supply device configured to supply fuel from an inside of a fuel tank to an internal combustion engine, comprising:

a cover body that is configured to be installed to an upper wall of the fuel tank;

a pump unit that is configured to be placed on a bottom wall of the fuel tank and is configured to discharge the fuel from the inside of the fuel tank toward the internal combustion engine; and a coupling stay that couples between the cover body and the pump unit, wherein:

the coupling stay includes:

an upper stay that extends on a lower side of the cover body; and a lower stay that is installed to the pump unit and is slidably fitted to the upper stay in a top-to-bottom direction; and a stress concentrating portion, which reduces a cross-sectional area to concentrate a stress around the stress concentrating portion, is formed at a specific location of the lower stay, the specific location being located immediately above a lower end part of the lower stay;

the lower stay is slidably fitted into the upper stay from a lower side of the upper stay;

the stress concentrating portion is formed at the specific location of the lower stay, which is placed at an outside of the upper stay;

the upper stay includes:

an upper tube segment that forms a hollow tubular portion; and an upper column segment that forms a solid column portion;

the lower stay includes:

a lower column segment that forms a solid column portion; and a lower tube segment that forms a hollow tubular portion;

the lower column segment is slidably fitted into the hollow tubular portion of the upper tube segment from a lower side of the hollow tubular portion of the upper tube segment;

the upper column segment is slidably fitted into the hollow tubular portion of the lower tube segment from an upper side of the hollow tubular portion of the lower tube segment; and the stress concentrating portion is formed at the specific location of the lower stay located in at least one of the lower column segment and the lower tube segment.

3. The fuel supply device according to claim 1, wherein the lower end part of the lower stay that receives a load, which is generated though expansion and contraction of the fuel tank, from the bottom wall.

4. The fuel supply device according to claim 1, wherein the stress concentrating portion is formed at the specific location of the lower stay in the solid column portion of the lower column segment.

5. The fuel supply device according to claim 1, wherein the solid column portion of the upper column segment extends continuously in a form of a rib from the hollow tubular portion of the upper tube segment.

6. The fuel supply device according to claim 1, wherein the stress concentrating portion is formed in a form of an oblique cut at the lower stay.

7. The fuel supply device according to claim 1, wherein the stress concentrating portion is formed in a form of recess at the lower stay.

8. The fuel supply device according to claim 1, wherein an upper end part of the lower stay is engaged to and is stopped by the upper stay when a slide fit length of the lower stay relative to the upper stay is maximized.

9. The fuel supply device according to claim 1, wherein:

the lower stay includes an engaging portion that is placed on a lower side of an upper end part of the lower stay; and the engaging portion is engaged to and is stopped by the upper stay when a slide fit length of the lower stay relative to the upper stay is maximized.

10. The fuel supply device according to claim 1, wherein:

the coupling stay further includes a resilient member that is engaged to the upper stay and exerts a restoring force in a downward direction against the lower stay;

the upper stay includes a first upper segment and a second upper segment are laterally placed side by side;

the lower stay includes a first lower segment and a second lower segment that are laterally placed side by side;

the first lower segment is slidably fitted to the first upper segment in the top-to-bottom direction and clamps the resilient member between the first upper segment and the first lower segment;

the second lower segment is slidably fitted to the second upper segment in the top-to-bottom direction; and the stress concentrating portion is formed at the specific location of the lower stay located in the first lower segment.

11. The fuel supply device according to claim 1, wherein:

the upper stay includes a first upper segment and a second upper segment that are laterally placed side by side and are integrally formed in one piece;

the lower stay includes a first lower segment and a second lower segment that are laterally placed side by side and are integrally formed in one piece;

the first lower segment is slidably fitted to the first upper segment in the top-to-bottom direction from a first fitting initial position; and the second lower segment is slidably fitted to the second upper segment in the top-to-bottom direction from a second fitting initial position, at which the slide fitting of the first lower segment relative to the first upper segment is further advanced in comparison to the first fitting initial position.

12. The fuel supply device according to claim 11, wherein:

a position of a first lower end part of the first upper segment coincides with a position of a second lower end part of the second upper segment in the top-to-bottom direction; and a position of a first upper end part of the first lower segment is upwardly displaced from a position of a second upper end part of the second lower segment.

13. The fuel supply device according to claim 11, wherein:

a position of a first lower end part of the first upper segment is downwardly displaced from a position of a second lower end part of the second upper segment; and a position of a first upper end part of the first lower segment coincides with a position of a second upper end part of the second lower segment in the top-to-bottom direction.

14. The fuel supply device according to claim 11, wherein:

a position of a first lower end part of the first upper segment is downwardly displaced from a position of a second lower end part of the second upper segment; and a position of a first upper end part of the first lower segment is upwardly displaced from a second upper end part of the second lower segment.

15. The fuel supply device according to claim 11, wherein:

a position of a first lower end part of the first upper segment is upwardly displaced from a position of a second lower end part of the second upper segment;

a position of a first upper end part of the first lower segment is upwardly displaced from a position of a second upper end part of the second lower segment; and an amount of displacement of the first upper end part relative to the second upper end part is larger than an amount of displacement of the first lower end part relative to the second lower end part.

16. The fuel supply device according to claim 11, wherein:

a position of a first lower end part of the first upper segment is downwardly displaced from a position of a second lower end part of the second upper segment;

a position of a first upper end part of the first lower segment is downwardly displaced from a position of a second upper end part of the second lower segment; and an amount of displacement of the first lower end part relative to the second lower end part is larger than an amount of displacement of the first upper end part relative to the second upper end part.

* * * * *